US009695594B2

(12) United States Patent
Van Wey

(10) Patent No.: US 9,695,594 B2
(45) Date of Patent: Jul. 4, 2017

(54) RIDGE VENT

(71) Applicant: LIBERTY DIVERSIFIED INTERNATIONAL, INC., New Hope, MN (US)

(72) Inventor: Scott Charles Van Wey, Crystal, MN (US)

(73) Assignee: Liberty Diversified International, Inc., New Hope, MN (US)

( * ) Notice: Subject to any disclaimer, the term of this patent is extended or adjusted under 35 U.S.C. 154(b) by 0 days.

(21) Appl. No.: 15/181,540

(22) Filed: Jun. 14, 2016

(65) Prior Publication Data

US 2016/0369513 A1 Dec. 22, 2016

Related U.S. Application Data

(60) Provisional application No. 62/180,364, filed on Jun. 16, 2015.

(51) Int. Cl.

| | |
|---|---|
| ***E04D 13/17*** | (2006.01) |
| ***F24F 7/02*** | (2006.01) |
| ***E04D 13/04*** | (2006.01) |

(52) U.S. Cl.

CPC ..... *E04D 13/176* (2013.01); *E04D 13/0477* (2013.01); *F24F 7/02* (2013.01); *E04D 2013/045* (2013.01)

(58) Field of Classification Search

CPC . E04D 13/174; E04D 13/176; E04D 13/0477; E04D 2013/045; E04D 2013/0454; F24F 7/02

See application file for complete search history.

(56) References Cited

U.S. PATENT DOCUMENTS

| | | | | |
|---|---|---|---|---|
| 183,532 | A * | 10/1876 | Brock | E04D 13/174 454/365 |
| 595,960 | A | 12/1897 | May | |
| 2,200,031 | A | 5/1940 | Lee | |
| 2,214,183 | A | 9/1940 | Seymour | |
| D124,294 | S | 12/1940 | Leslie | |
| 2,300,842 | A | 11/1942 | Leslie | |
| D155,345 | S | 9/1949 | Johnson | |
| 2,490,220 | A | 12/1949 | Leslie | |
| 2,505,147 | A | 4/1950 | Scallon | |

(Continued)

FOREIGN PATENT DOCUMENTS

| | | |
|---|---|---|
| DE | 198 21 035 | 5/1998 |
| DE | 299 12 644 | 7/1999 |

(Continued)

*Primary Examiner* — Brent W Herring

(74) *Attorney, Agent, or Firm* — Barnes & Thornburg LLP

(57) ABSTRACT

An illustrative embodiment of the present disclosure provides a ridge vent having a longitudinally-extending top panel, a longitudinally-extending first side, a longitudinally-extending second side, and a first end. The longitudinally-extending top panel is bendable along a longitudinally-extending axis. The longitudinally-extending first side is composed of a longitudinally-extending first arcuate side panel having a concave shape directed toward the ridge vent interior. And the longitudinally-extending second side is composed of a longitudinally-extending second arcuate side panel having a concave shape directed toward the ridge vent interior.

19 Claims, 18 Drawing Sheets

(56) References Cited

U.S. PATENT DOCUMENTS 2,579,662 A 12/1951 Gibson
2,625,094 A * 1/1953 Bonforte ..... E04D 13/174 454/365
2,704,500 A 3/1955 Bonforte
2,799,214 A 7/1957 Roose
D180,809 S 8/1957 Rosen
2,806,419 A 9/1957 Artis
2,826,136 A 3/1958 Smith
2,868,104 A 1/1959 Honholt et al.
2,924,165 A 2/1960 Doherty
D188,962 S 10/1960 Zeiler
D191,018 S 8/1961 Kearney et al.
3,079,853 A 3/1963 Smith
3,082,677 A 3/1963 Pease
3,093,059 A 6/1963 Metz
3,185,070 A 5/1965 Smith
3,236,170 A 2/1966 Meyer
3,311,047 A 3/1967 Smith
3,326,113 A 6/1967 Smith
3,481,263 A 12/1969 Belden
D216,795 S 3/1970 Field
D217,721 S 6/1970 Guerney
3,625,134 A 12/1971 Smith
3,660,955 A 5/1972 Simon
3,685,426 A 8/1972 Rosa
RE27,943 E 3/1974 Smith
3,889,892 A 6/1975 Meleod
3,949,657 A 4/1976 Sells
D240,827 S 8/1976 Hill et al.
4,090,435 A 5/1978 Vallee
D254,804 S 4/1980 Ballard et al.
D257,282 S 10/1980 Roberts
D257,283 S 10/1980 Roberts
D259,208 S 5/1981 Mccullough
D259,951 S 7/1981 Briedert
4,280,399 A 7/1981 Cunning
4,297,818 A 11/1981 Anderson
4,325,290 A 4/1982 Wolfert
D269,456 S 6/1983 McDermott
4,393,633 A 7/1983 Charniga
D277,027 S 1/1985 Waltz et al.
D277,028 S 1/1985 Waltz et al.
4,545,291 A 10/1985 Kutsch et al.
D281,274 S 11/1985 Wright
4,554,862 A 11/1985 Wolfert
4,558,637 A 12/1985 Mason
4,622,887 A 11/1986 Peterson
4,643,080 A 2/1987 Trostle
4,676,147 A 6/1987 Mankowski
4,701,197 A 10/1987 Thornton et al.
4,762,053 A 8/1988 Wolfert
4,776,262 A 10/1988 Curran
4,803,813 A 2/1989 Fiterman
4,807,409 A 2/1989 Sells
4,817,506 A 4/1989 Cashman
4,843,953 A 7/1989 Sells
D304,367 S 10/1989 Saas
4,876,950 A 10/1989 Rudeen
4,899,505 A 2/1990 Williamson et al.
4,903,445 A 2/1990 Mankowski
4,907,499 A 3/1990 James
4,924,761 A 5/1990 MacLeod et al.
4,942,699 A 7/1990 Spinelli
4,957,037 A 9/1990 Tubbesing
5,002,816 A 3/1991 Hofmann
5,005,330 A 4/1991 Todisco
5,009,149 A 4/1991 MacLeod et al.
D317,819 S 6/1991 Sello
5,022,203 A 6/1991 Boyd
5,022,314 A 6/1991 Waggoner
D320,847 S 10/1991 Lanigan
5,052,286 A 10/1991 Tubbesing
5,054,254 A 10/1991 Sells
5,060,431 A 10/1991 MacLeod et al.
5,070,771 A 12/1991 Mankowski
5,081,914 A 1/1992 Mejia
5,092,225 A 3/1992 Sells
5,094,041 A 3/1992 Kasner
5,094,049 A 3/1992 Sells
5,095,810 A 3/1992 Robinson
5,099,627 A 3/1992 Coulton et al.
5,112,278 A 5/1992 Roberts
5,122,095 A 6/1992 Wolfert
D329,694 S 9/1992 Wimberly
5,149,301 A 9/1992 Gates
5,167,579 A 12/1992 Rotter
5,174,076 A 12/1992 Schiedegger
5,238,450 A 8/1993 Rotter
5,242,736 A 9/1993 Van Erden et al.
5,288,269 A 2/1994 Hansen
5,304,095 A 4/1994 Morris
5,319,908 A 6/1994 Van Erden et al.
5,326,318 A 7/1994 Rotter
5,328,407 A 7/1994 Sells
5,331,783 A 7/1994 Kasner
5,339,582 A 8/1994 Sells
5,349,804 A 9/1994 Van Erden et al.
5,352,154 A 10/1994 Rotter
5,402,611 A 4/1995 Vagedes
5,419,867 A 5/1995 Van Erden et al.
5,425,672 A 6/1995 Rotter
5,427,571 A 6/1995 Sells
5,435,780 A 7/1995 Ayles
5,439,417 A 8/1995 Sells
5,457,920 A 10/1995 Waltz
5,458,538 A 10/1995 MacLeod et al.
5,472,089 A 12/1995 Specogna et al.
5,535,558 A 7/1996 Rieke et al.
5,542,882 A 8/1996 Sells
5,560,157 A 10/1996 Rotter
5,561,952 A 10/1996 Damron
5,561,953 A 10/1996 Rotter
5,591,080 A 1/1997 Ward
5,593,348 A * 1/1997 Rickert ..... E04D 1/36 454/365
5,603,657 A 2/1997 Sells
5,651,734 A 7/1997 Morris
5,662,522 A 9/1997 Waltz
5,673,521 A 10/1997 Coulton et al.
5,704,834 A 1/1998 Sells
5,711,116 A 1/1998 Hasan
5,772,502 A 6/1998 Smith
5,803,805 A 9/1998 Sells
5,816,014 A 10/1998 Tzeng
5,830,059 A 11/1998 Sells
5,897,434 A 4/1999 Arbucci
5,902,432 A 5/1999 Coulton et al.
5,921,863 A 7/1999 Sells
5,934,995 A 8/1999 Morris
5,946,868 A 9/1999 Morris
5,947,817 A 9/1999 Morris
5,971,848 A 10/1999 Nair et al.
6,015,343 A 1/2000 Castillo et al.
6,039,646 A 3/2000 Sells
6,079,166 A 6/2000 Mason et al.
D428,484 S 7/2000 Zirk
6,102,794 A 8/2000 Cline
D431,291 S 9/2000 McKee
6,128,869 A 10/2000 Brotherton
6,149,517 A 11/2000 Hansen
6,155,008 A 12/2000 McKee
6,212,833 B1 4/2001 Henderson
6,227,963 B1 5/2001 Headrick
6,233,887 B1 5/2001 Smith
6,260,315 B1 7/2001 Smith
6,267,688 B1 7/2001 Morelli, Sr.
6,277,024 B1 8/2001 Coulton
RE37,388 E 9/2001 Kasner
6,298,613 B1 10/2001 Coulton et al.
6,302,787 B1 10/2001 Graft, Jr.
6,308,472 B1 10/2001 Coulton et al.
6,357,193 B1 3/2002 Morris
6,361,434 B1 3/2002 Brandon
6,371,847 B2 4/2002 Headrick

(56) References Cited

U.S. PATENT DOCUMENTS

| | | | | |
|---|---|---|---|---|
| 6,447,392 | B1 | 9/2002 | Henderson | |
| 6,450,882 | B1 | 9/2002 | Morris et al. | |
| 6,458,029 | B2 | 10/2002 | Morris | |
| 6,482,084 | B2 | 11/2002 | Hansen | |
| 6,487,826 | B1 | 12/2002 | McCorsley et al. | |
| 6,491,581 | B1 | 12/2002 | Mankowski | |
| D471,624 | S | 3/2003 | Hurlstone et al. | |
| 6,558,251 | B2 | 5/2003 | Sells | |
| 6,578,325 | B2 | 6/2003 | Henderson | |
| 6,579,171 | B2 | 6/2003 | Lawless, III et al. | |
| 6,599,184 | B2 | 7/2003 | Morris | |
| 6,612,924 | B1 | 9/2003 | Mantyla | |
| 6,623,354 | B2 | 9/2003 | Morris et al. | |
| 6,684,581 | B2 | 2/2004 | Robinson | |
| 6,767,281 | B2 | 7/2004 | McKee | |
| 6,793,574 | B1 | 9/2004 | Robinson | |
| 6,881,144 | B2 | 4/2005 | Hansen et al. | |
| D511,847 | S | 11/2005 | Ciepliski | |
| D511,848 | S | 11/2005 | Ciepliski | |
| 6,966,830 | B2 | 11/2005 | Hurlstone et al. | |
| D512,774 | S | 12/2005 | O'hagin et al. | |
| 6,981,916 | B2 | 1/2006 | Coulton | |
| 6,991,535 | B2 | 1/2006 | Ciepliski et al. | |
| 7,024,828 | B2 | 4/2006 | Headrick | |
| 7,044,852 | B2 | 5/2006 | Horton | |
| 7,165,363 | B2 | 1/2007 | Headrick, II et al. | |
| 7,219,473 | B2 | 5/2007 | Mantyla et al. | |
| D556,314 | S | 11/2007 | Daniels, II et al. | |
| 7,384,331 | B2 | 6/2008 | Coulton | |
| 7,485,034 | B2 | 2/2009 | Sells | |
| 7,694,467 | B2 * | 4/2010 | Lin | E04D 13/174 454/364 |
| 8,069,621 | B2 | 12/2011 | Mantyla et al. | |
| D654,161 | S | 2/2012 | Holland et al. | |
| 8,276,331 | B2 | 10/2012 | Polumbus et al. | |
| 8,291,655 | B2 | 10/2012 | McGlothlin | |
| 8,302,352 | B2 | 11/2012 | Bahn | |
| 8,322,089 | B2 | 12/2012 | Railkar et al. | |
| 8,333,639 | B2 * | 12/2012 | Collister | E04D 13/174 454/364 |
| RE44,832 | E | 4/2014 | Headrick | |
| 8,790,167 | B2 | 7/2014 | Holland et al. | |
| 8,925,262 | B2 * | 1/2015 | Railkar | E04D 13/103 454/365 |
| 9,157,239 | B2 * | 10/2015 | Allen | E04D 13/17 |
| 2001/0019941 | A1 | 9/2001 | Headrick | |
| 2001/0049261 | A1 | 12/2001 | McKee et al. | |
| 2002/0016150 | A1 | 2/2002 | Hansen | |
| 2003/0054754 | A1 | 3/2003 | McKee | |
| 2003/0153262 | A1 | 8/2003 | Mantyla | |
| 2004/0198216 | A1 | 10/2004 | Morris et al. | |
| 2004/0200170 | A1 | 10/2004 | Fabel | |
| 2004/0266331 | A1 | 12/2004 | Hansen et al. | |
| 2005/0055920 | A1 | 3/2005 | Lajewski | |
| 2005/0090197 | A1 | 4/2005 | Coulton | |
| 2005/0233691 | A1 | 10/2005 | Horton | |
| 2006/0035582 | A1 | 2/2006 | Collister et al. | |
| 2006/0040608 | A1 | 2/2006 | Coulton | |
| 2006/0111034 | A1 | 5/2006 | Parry | |
| 2006/0196130 | A1 | 9/2006 | Mantyla et al. | |
| 2007/0000192 | A1 | 1/2007 | Mantyla et al. | |
| 2007/0141975 | A1 | 6/2007 | Polston | |
| 2007/0167130 | A1 | 7/2007 | Brochu | |
| 2007/0173191 | A1 | 7/2007 | Daniels, II et al. | |
| 2009/0049769 | A1 | 2/2009 | Kaseda | |
| 2010/0112932 | A1 * | 5/2010 | Grubka | E04D 13/174 454/365 |
| 2011/0124280 | A1 | 5/2011 | Railkar et al. | |
| 2011/0195655 | A1 | 8/2011 | Holland et al. | |
| 2011/0209423 | A1 | 9/2011 | McGlothlin | |
| 2011/0225907 | A1 * | 9/2011 | Chang | E04D 3/30 52/198 |
| 2012/0011790 | A1 | 1/2012 | Polumbus et al. | |
| 2012/0047828 | A1 | 3/2012 | Bahn | |
| 2012/0096782 | A1 | 4/2012 | Railkar et al. | |
| 2012/0144763 | A1 | 6/2012 | Antonic | |
| 2013/0074428 | A1 | 3/2013 | Allen et al. | |
| 2014/0165481 | A1 | 6/2014 | Pavlansky et al. | |
| 2014/0179220 | A1 | 6/2014 | Railkar et al. | |
| 2014/0202093 | A1 | 7/2014 | Knighton | |
| 2014/0259998 | A1 | 9/2014 | Railkar et al. | |
| 2014/0260005 | A1 | 9/2014 | Mankowski | |
| 2014/0273808 | A1 | 9/2014 | Mankowski | |

FOREIGN PATENT DOCUMENTS

| | | |
|---|---|---|
| GB | 2 186 898 A | 2/1986 |
| WO | WO 84/02970 | 1/1983 |
| WO | WO 99/35446 | 7/1999 |

* cited by examiner

RIDGE VENT

RELATED APPLICATIONS

The present application relates to and claims priority to U.S. Provisional Patent Application, Ser. No. 62/180,364, filed on Jun. 16, 2015 entitled "Ridge Vent." The subject matter disclosed in the above-referenced applications is hereby expressly incorporated by reference into the present application.

TECHNICAL FIELD AND SUMMARY

The present disclosure relates to roof ventilating devices and, in particular, to roof ventilating devices with new, functional edge profiles.

An illustrative embodiment of the present disclosure provides a ridge vent that includes a side or leading edge design that promotes better ventilation by drawing air out of both sides of the vent. The design of this leading edge is believed not to cause a back draw of materials such as rain or snow. In addition to the leading edge design, louvers may be located on the top of the ridge vent adjacent the leading edge to help keep material from getting trapped in the vent area. Weep holes at the lower end of the sides of the ridge vent promote faster water drainage out of the ridge vent. Other side profiles and leading edge designs are also disclosed herein.

An illustrative embodiment of the present disclosure provides a ridge vent. The ridge vent comprises a longitudinally-extending top panel, a longitudinally-extending first side, a longitudinally-extending second side, a first end, a first plurality of openings, a second plurality of openings, a first plurality of depending tabs, and a second plurality of depending tabs. The longitudinally-extending top panel is bendable along a longitudinally-extending axis. The longitudinally-extending first side depends from the top panel and is located substantially parallel to, and spaced apart from, the longitudinally-extending axis. The longitudinally-extending second side depends from the top panel and is located substantially parallel to, and spaced apart from, the longitudinally-extending axis. The longitudinally-extending first side is also located on an opposite side of the longitudinally-extending axis from the longitudinally-extending second side. The first end depends from the top panel and extends between the first and second sides. The top panel, first end, and first and second sides collectively form a ridge vent interior that is segregated from exterior of the ridge vent. The first plurality of openings are formed on the top panel, are positioned adjacent each other, and collectively longitudinally-extend along a first longitudinal extent that is substantially parallel to, and spaced apart from, the longitudinally-extending axis. The second plurality of openings are formed on the top panel and positioned adjacent each other. They also collectively longitudinally extend along a second longitudinal extent that is substantially parallel to, and spaced apart from, the longitudinally-extending axis. The first plurality of openings are located on an opposite side of the longitudinally-extending axis from the second plurality of openings. The top panel includes a first terminus that extends longitudinally along the first side and is curved downwardly with respect to the top panel to a first longitudinally extending edge. The longitudinally-extending first side is composed of a longitudinally-extending first arcuate side panel having a concave shape directed toward the ridge vent interior, wherein a first portion of the concave shape of the longitudinally-extending first arcuate side panel is located underneath the top panel, and a second portion of the longitudinally-extending concave shape of the longitudinally-extending first arcuate side panel is located away from underneath the top panel. The longitudinally-extending second side is composed of a longitudinally-extending second arcuate side panel having a concave shape directed toward the ridge vent interior, wherein a first portion of the concave shape of the longitudinally-extending second arcuate side panel is located underneath the top panel, and a second portion of the longitudinally-extending concave shape of the longitudinally-extending second arcuate side panel is located away from underneath the top panel. The first end depends from the top panel and extends between the first and second sides, and includes a first plurality of depending tabs. Each of the first plurality of depending tabs are spaced apart from each other. The second plurality of depending tabs are spaced apart from each other, and are positioned substantially parallel to the first plurality of depending tabs. Each of the second plurality of depending tabs faces a space located between each of the first plurality of depending tabs.

In the above and other embodiments, the ridge vent may further comprise: a second end depending from the top panel and extending between the first and second sides and spaced apart from the first end; the second end depending from the top panel and extending between the first and second sides, and includes a first plurality of depending tabs, wherein each of the first plurality of depending tabs is spaced apart from each other, and a second plurality of depending tabs, wherein each of the second plurality of depending tabs is spaced apart from each other, wherein the second plurality of depending tabs are positioned substantially parallel to first plurality of depending tabs, and wherein each of the second plurality of depending tabs faces a space located between each of the first plurality of depending tabs; the longitudinally-extending first side includes a plurality of weep holes located on the second portion of the longitudinally-extending concave shape of the longitudinally-extending first arcuate side panel; the longitudinally-extending second side includes a plurality of weep holes located on the second portion of the longitudinally-extending concave shape of the longitudinally-extending second arcuate side panel; a plurality of tabs, wherein one tab of the plurality of tabs is located on an underside portion of the longitudinally-extending first arcuate side panel of the longitudinally-extending first side adjacent one weep hole of the plurality of weep holes; a plurality of tabs, wherein one tab of the plurality of tabs is located on an underside portion of the longitudinally-extending second arcuate side panel of the longitudinally-extending second side adjacent one weep hole of the plurality of weep hole; the top panel including an underside surface facing the ridge vent interior, wherein the ridge vent further comprises a plurality of first row of downward-depending tabs and a second row of downward-depending tabs, the first row of downward-depending tabs collectively longitudinally-extend along a first longitudinal extent that is substantially parallel to, and spaced apart from, the longitudinally-extending axis; the second row of downward-depending tabs collectively longitudinally-extend along a second longitudinal extent that is substantially parallel to, and spaced apart from, the first row of downward-depending tabs and the longitudinally-extending axis; each tab from the first row of the plurality of tabs being located transverse to the longitudinally-extending axis of the top panel, and the second row of the plurality of tabs being located transverse to the longitudinally-extending axis of the top panel; each tab of the first row of the plurality of tabs being located parallel to and non-collinear to each tab of the second row of the plurality of tabs; each tab from the first row of tabs includes a pin formed thereon; and each tab from the second row of tabs includes a pin formed thereon.

Another illustrative embodiment of the present disclosure provides a ridge vent that comprises a longitudinally-extending top panel, a longitudinally-extending first side, a longitudinally-extending second side, and a first end. The longitudinally-extending top panel is bendable along a longitudinally-extending axis. The longitudinally-extending first side depends from the top panel and is located substantially parallel to, and spaced apart from, the longitudinally-extending axis. The longitudinally-extending second side depends from the top panel and is located substantially parallel to, and spaced apart from, the longitudinally-extending axis. The longitudinally-extending first side is located on an opposite side of the longitudinally-extending axis from the longitudinally-extending second side. The top panel, first end, and first and second sides collectively form a ridge vent interior that is segregated from exterior of the ridge vent. The first end depends from the top panel and extends between the first and second sides. The top panel includes a first terminus that extends longitudinally along the first side, wherein the first terminus is curved downwardly with respect to the top panel to a first longitudinally extending edge. The longitudinally-extending first side is composed of a longitudinally-extending first arcuate side panel having a concave shape directed toward the ridge vent interior, wherein a first portion of the concave shape of the longitudinally-extending first arcuate side panel is located underneath the top panel, and a second portion of the longitudinally-extending concave shape of the longitudinally-extending first arcuate side panel is located away from underneath the top panel. And lastly, the longitudinally-extending second side is composed of a longitudinally-extending second arcuate side panel having a concave shape directed toward the ridge vent interior, wherein a first portion of the concave shape of the longitudinally-extending second arcuate side panel is located underneath the top panel, and a second portion of the longitudinally-extending concave shape of the longitudinally-extending second arcuate side panel is located away from underneath the top panel.

In the above and other embodiments, the ridge vent may further comprise: a first plurality of openings formed on the top panel that are positioned adjacent each other, wherein first the plurality of openings collectively longitudinally-extend along a first longitudinal extent that is substantially parallel to, and spaced apart from, the longitudinally-extending axis; a second plurality of openings formed on the top panel that are positioned adjacent each other, wherein the second plurality of openings collectively longitudinally extend along a second longitudinal extent that is substantially parallel to, and spaced apart from, the longitudinally-extending axis; the first plurality of openings is located on an opposite side of the longitudinally-extending axis from the second plurality of openings, wherein the first end depending from the top panel and extending between the first and second sides includes a first plurality of depending tabs, wherein each of the first plurality of depending tabs are spaced apart from each other; a second plurality of depending tabs, wherein each of the second plurality of depending tabs are spaced apart from each other, wherein the second plurality of depending tabs are positioned substantially parallel to first plurality of depending tabs, wherein each of the second plurality of depending tabs faces a space located between each of the first plurality of depending tabs; and the longitudinally-extending top panel is rollable along its longitudinal-extending axis.

Additional features and advantages of the ridge vent will become apparent to those skilled in the art upon consideration of the following detailed descriptions exemplifying the best mode of carrying out the ridge vent as presently perceived.

BRIEF DESCRIPTION OF THE DRAWINGS

The present disclosure will be described hereinafter with reference to the attached drawings which are given as non-limiting examples only, in which.

DISCLOSURE OF THE ILLUSTRATIVE EMBODIMENT

Figure 1:
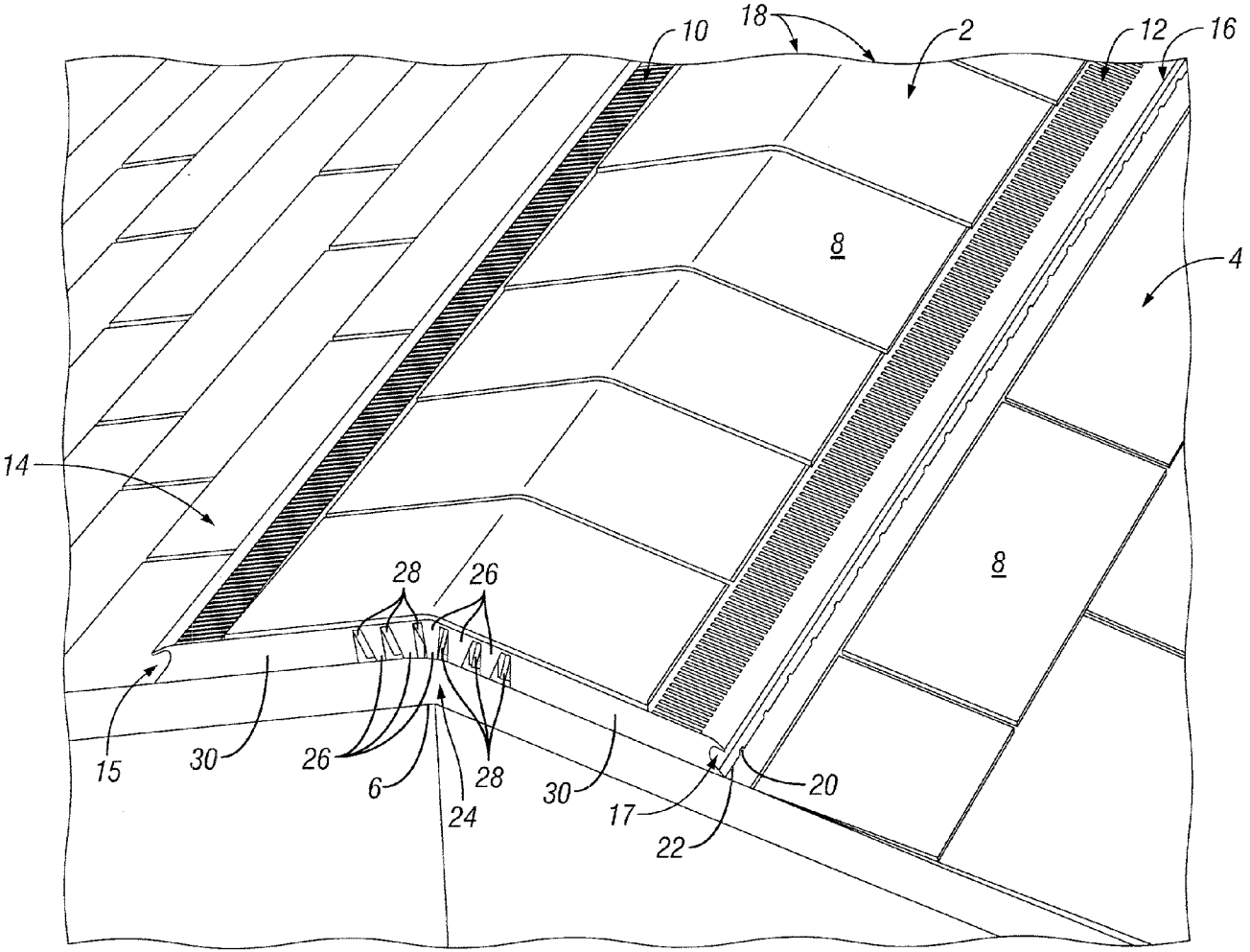
FIG. 1 is a perspective view of an illustrative embodiment of a ridge vent, according to the present disclosure, and is attached to a roof.

A perspective view of an illustrative embodiment of ridge vent 2, according to the present disclosure, attached to a roof 4, is shown in FIG. 1. For illustrative purposes, ridge vent 2 is shown folded over a roof peak 6 and located in its use position with shingles 8 affixed thereto. It is appreciated, however, that the shingles do not cover air louvers or vent openings 10 and 12 of ridge vent 2. In the illustrated embodiment, leading edges 14 and 16 extend along both longitudinal sides of ridge vent 2 and are believed to promote enhanced ventilation by drawing air out of both sides of the vent. Leading edges 14 and 16 of the sides form a "delta wing"-shape design having a compound curve cross-section 15 and 17, respectively. For purposes of this disclosure, a compound curve is a curve made up of at least two arcs of distinct radii and having a common target at their point of juncture. This design is believed not to cause a back draw of materials, such as rain or snow, into the ridge vent on the non-windward side of the same. This is believed a problem with traditionally baffled vents.

Vent openings or louvers 10 and 12 are located on the top of ridge vent 2 between shingle area 18 and leading edges 14 and 16 respectively. Vent openings 10 and 12 help keep material from getting trapped in ridge vent 2. Illustratively, a plurality of weep holes 20 may be formed on lower or bottom edge 22 of the sides of ridge vent 2 to promote fast drainage of any water that gets into ridge vent 2.

It is appreciated that ridge vent 2 is bendable to match the pitch of roof 4. A dual wall of alternating tabs 26 and 28 off end 30 of ridge vent 2 at its bend. It is further appreciated that ridge vent 2 may adjust, illustratively, between a 3/12 to a 16/12 pitch. It is also appreciated that vent 2 may be cut to any desired length. In an illustrative embodiment, ridge vent 2 may be made from a polypropylene, high density polypropylene or similar material suitable for a roof application.

Figures 2, 3, 4:
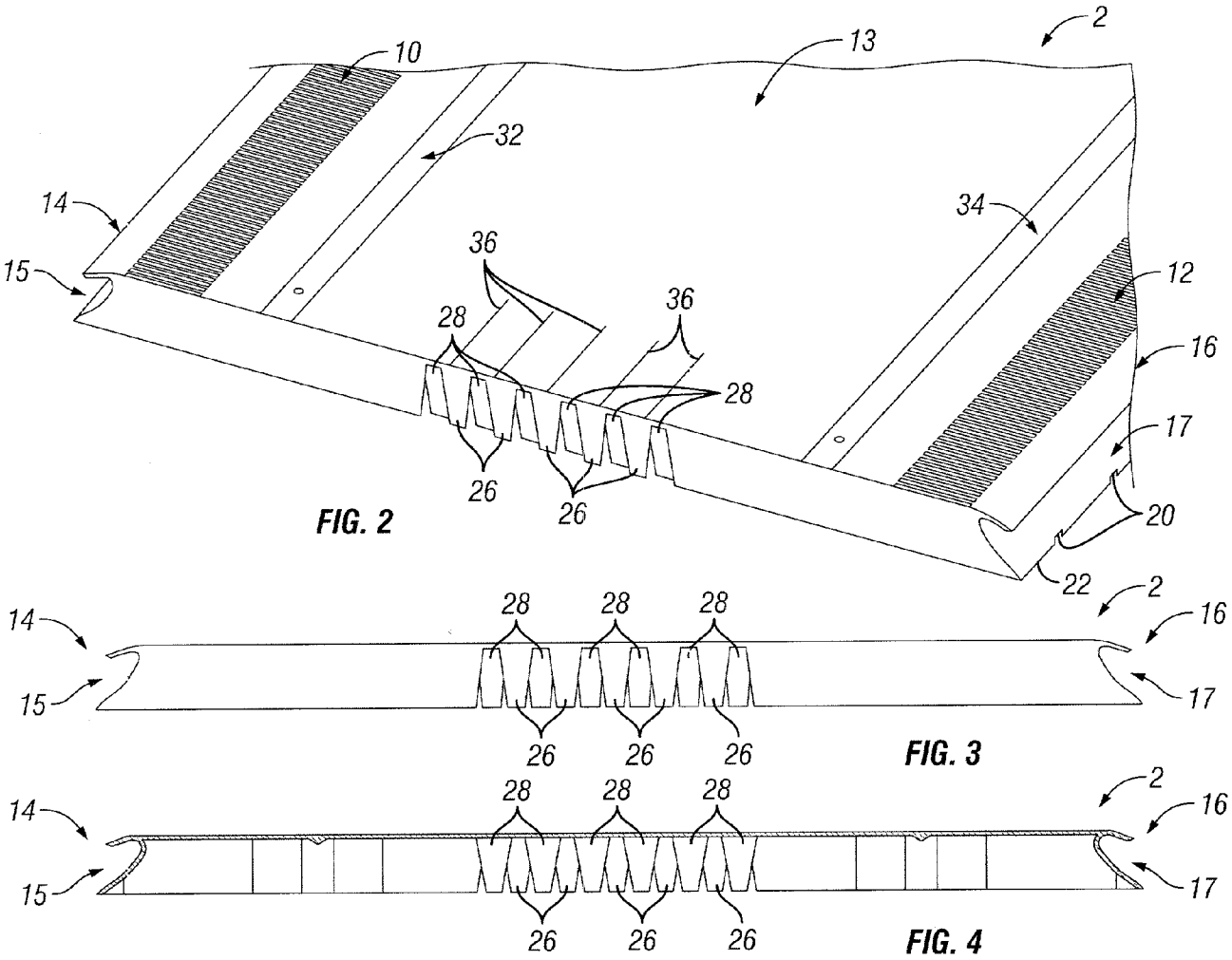
FIG. 2 is a top-perspective-end view of the ridge vent of FIG. 1 showing the edge profiles of the ridge vent, as well as its end.
FIG. 3 is an end view of the ridge vent of FIG. 1 showing the end profile, as well as the shape of the side edge profiles.
FIG. 4 is a cut-away view across the longitudinal extent of the ridge vent, again showing the edge profile of the ridge vent, as well as certain interior structures.

Top perspective, end, and end cut away views of ridge vent 2 are shown in FIGS. 2, 3, and 4. These views further illustrate the compound curve "delta-wing"-shape 15 and 17 on leading edge sides 14 and 16, respectively. It is believed the design creates an area of low pressure in front of ridge vent 2, as air passes over leading edges 14 and 16. Furthermore, this particular leading edge shape gives ridge vent 2 a unique appearance with a darker shadow line and lower profile making it less noticeable from the ground. The hook shape of the vent area is also believed to provide better protection from wind-driven rain and snow.

Also shown in FIG. 2, are nail lines 32 and 34, and center alignment and slot guides 36 located on the top pane of vent 2. Louvers 10 and 12 located on top panel 13 keep material from getting trapped in the vent area. The end and cross-sectional views in FIGS. 3 and 4, demonstrate how end tabs 26 and 28 are in an overlapping-type arrangement to close off the end ridge vent 2 when it is folded over the roof peak.

Figure 5:
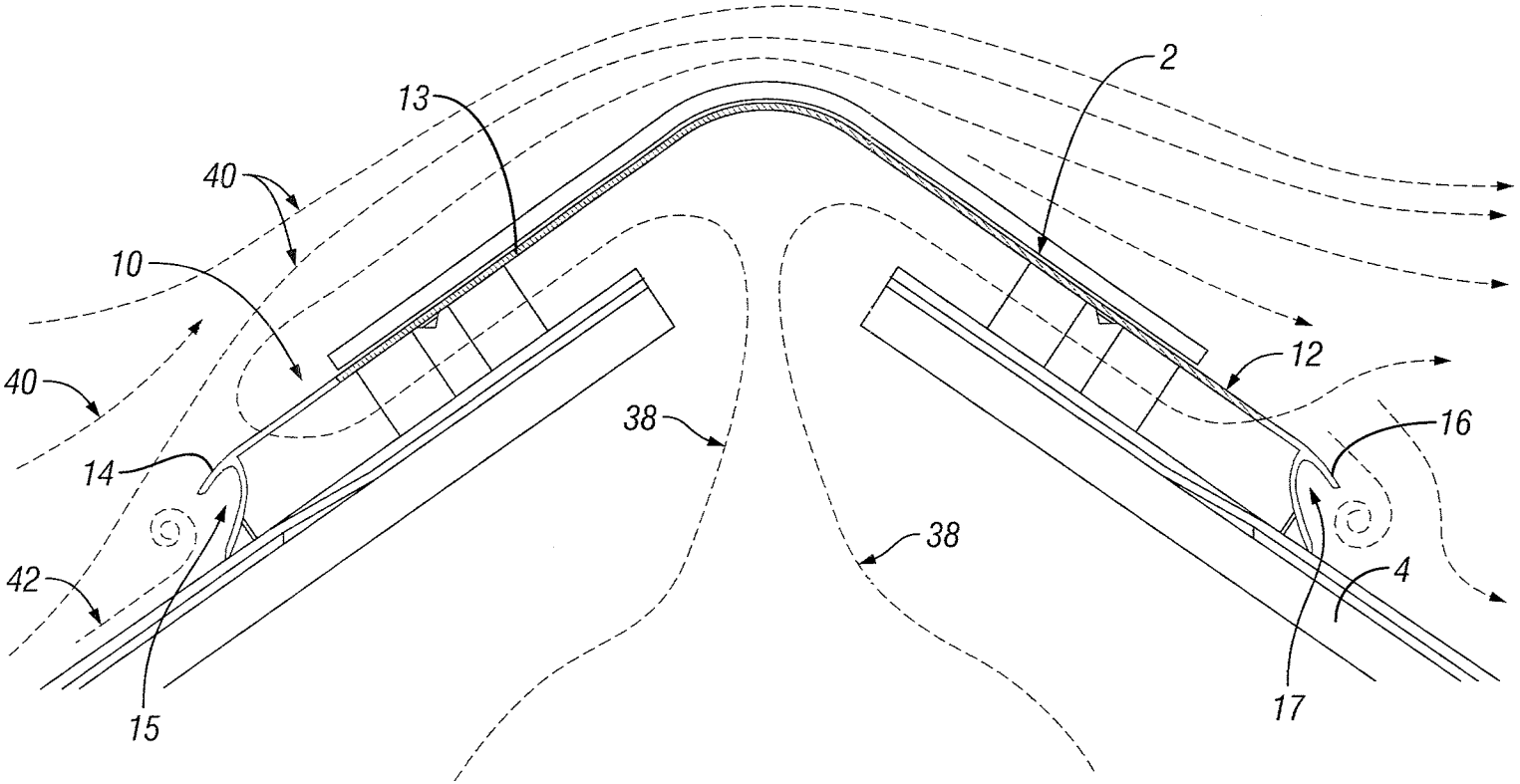
FIG. 5 is an end cut-away view across the cross-section of the ridge vent of FIG. 1 attached to a roof including illustrative air flow paths inside and outside of the roof.

An end cross-section view of ridge vent 2 attached to a roof 4 is shown in FIG. 5. This view also shows illustrative air flow paths 38, 40, 42 both inside and outside of roof 4. Illustratively, air flow 38 from inside the roof exits the louvers 10 and 12 to the outside as shown, when the wind direction is illustratively traveling from left to right. The opposite takes place with the wind direction traveling from right to left. As shown in FIG. 5, a hook or wave-shape air flow 40 is formed that directs air flow over louvers 10 and 12 located on both sides of top panel 13 of ridge vent 2. It is believed that leading edges 14 and 16 with profiles 15 and 17 help pull air out of the attic as wind passes over the ridge vent. It is not believed that the leading edge creates draw from the non-windward side of ridge vent 2, as indicated by reference number 42. This is desirable so material from outside is not pulled into the attic through ridge vent 2. The compound curve or delta-wing profiles 15 and 17 may result in areas of low pressure forming in front of the sides of the ridge vent, as air passes over the leading edge.

Figure 6:
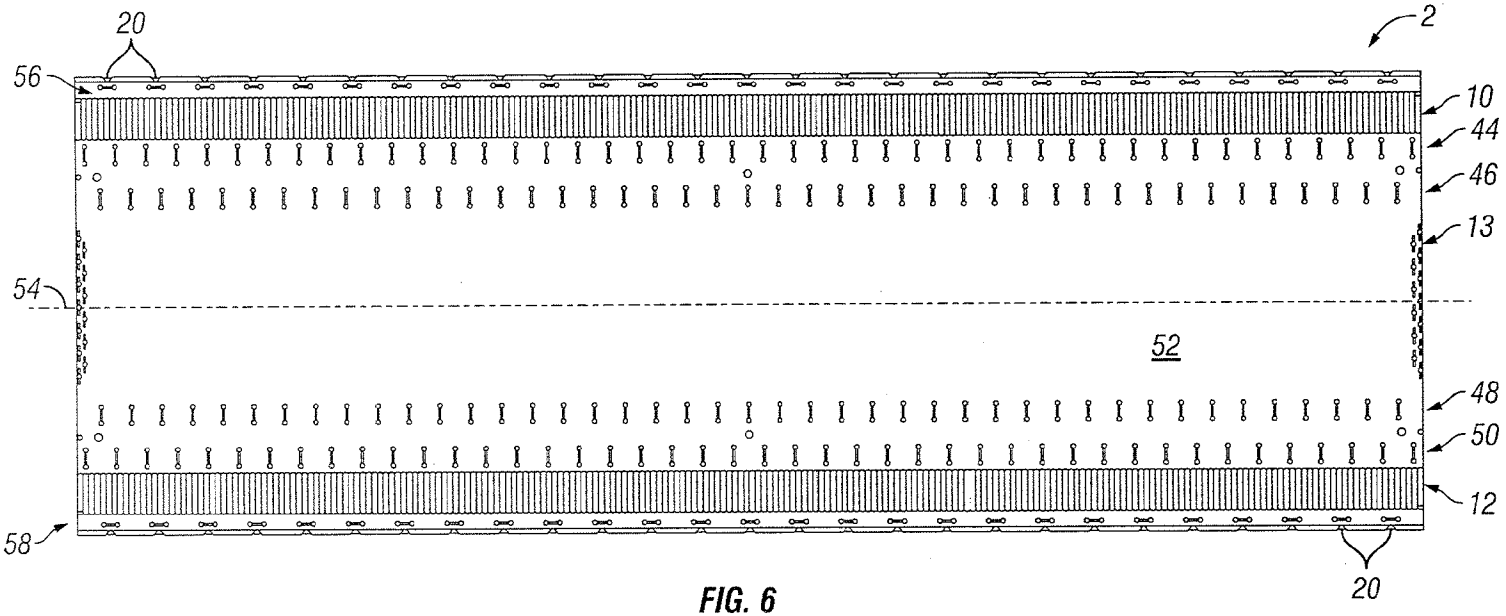
FIG. 6 is an underside view of the ridge vent.

An underside view of ridge vent 2 is shown in FIG. 6 depicting further underside features of ridge vent 2. This illustrative embodiment shows rows of ribs 44, 46, 48, and 50 extending from underside 52 of top panel 13. These rows of ribs 44, 46, 48, and 50 illustratively extend parallel to louvers 10 and 12 and to longitudinal axis 54 along the longitudinal extent of ridge vent 2. Individual ribs, however extend transverse to longitudinal axis 54. Also, the rows of ribs 44, 46, 48, and 50 are illustratively offset from each other and positioned on the underside of top panel 13 between rows of louvers 10 and 12. Also extending from the underside surface 52 of top panel 13 are rows of inner wall tabs 56 and 58. Each row includes a tab located behind one of the plurality weep holes 20. In the illustrative embodiment, tab rows 56 and 58 extend essentially parallel to longitudinal axis 54 and each row 56 and 58 are located outside the rows of louvers 10 and 12. In other words, rows of louvers 10 and 12 are positioned between the rows of inner wall tab rows 56 and 58 as shown. It is further appreciated, that with respect to ridge vent 2's interior space, the net free area for any air flow pathway shown via the gross cross-sectional area is believed calculated by the gross cross-sectional area less the area of any physical obstructions at the smallest and most critical cross-sectional area of the airway. It is appreciated that exterior openings into the attic space should have openings that will prevent the entry of birds, squirrels, rodents, snakes, and other animals. The louver openings may should, therefore, be a minimum of ⅛-inch and not exceed ¼-inch.

The vent slot opening in the roof should be illustratively sized to provide the required air flow in addition to the protection. In an illustrative embodiment, the vent openings for this ridge vent are about 0.126 inches wide by about 1.25 inches long. In a typical 4 foot length, there may be illustratively about 464 louvers in rows 10 and 12 on the underside of top panel 13 of the vent. The total square inches of opening on the top surface of the vent is about 73.08 square inches. The area of opening for the vent is about 18.27 square inches per lineal foot. It is appreciated that such a balanced ventilation system may allow heat and moisture to escape from the attic. It also may help prevent ice from damaging and prematurely deteriorating shingles by keeping the added temperature closer to the outside temperature. Ridge vents and soffit vents may be sized to work with each other. This is why the net free ventilation area of the vent is useful information.

Figure 7:
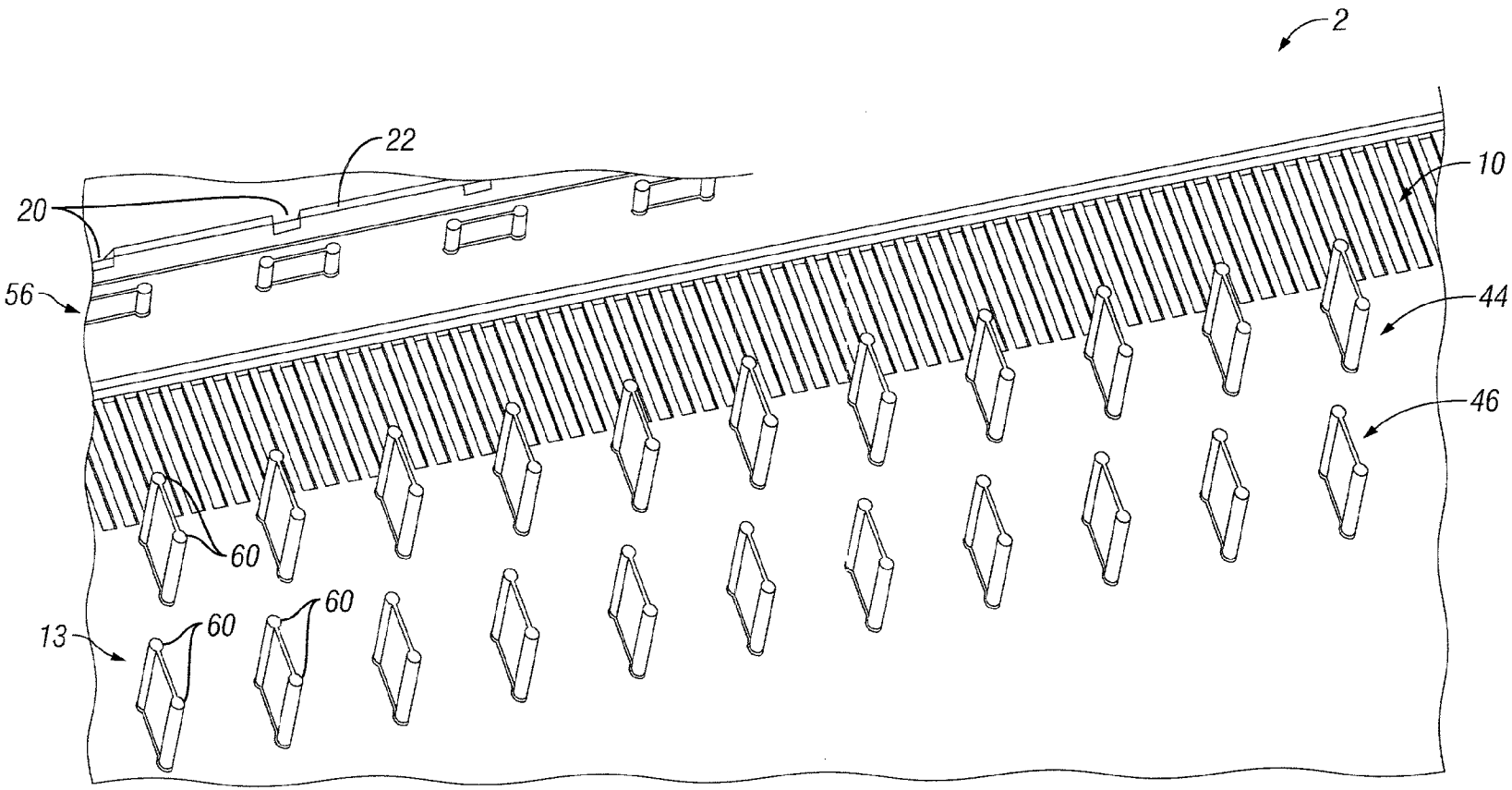
FIG. 7 is a perspective underside detail view of the ridge vent.

A perspective underside detail view of a portion of ridge vent 2 is shown in FIG. 7. In the illustrative embodiment support rib rows 44, 46 (as well as rows 48 and 50) hold up top panel 13 of ridge vent 2 when installed on roof 4. They also provide strength and support to the nailing line 32 and assist keeping the vent from crushing during installation. At the same time, rib rows 44, 46, 48, and 50 are designed not to impede air flow. In the illustrated embodiment, the support ribs are formed with a rounded inject pins 60 on each side. In addition, each row of ribs 44 and 46, and 48 and 50 are positioned offset from each other in the illustrative manner shown in the drawings. The row of inner wall tabs 56 (like row 58), are positioned behind weep holes 20 to block entry into the vent area.

Figures 8, 9:
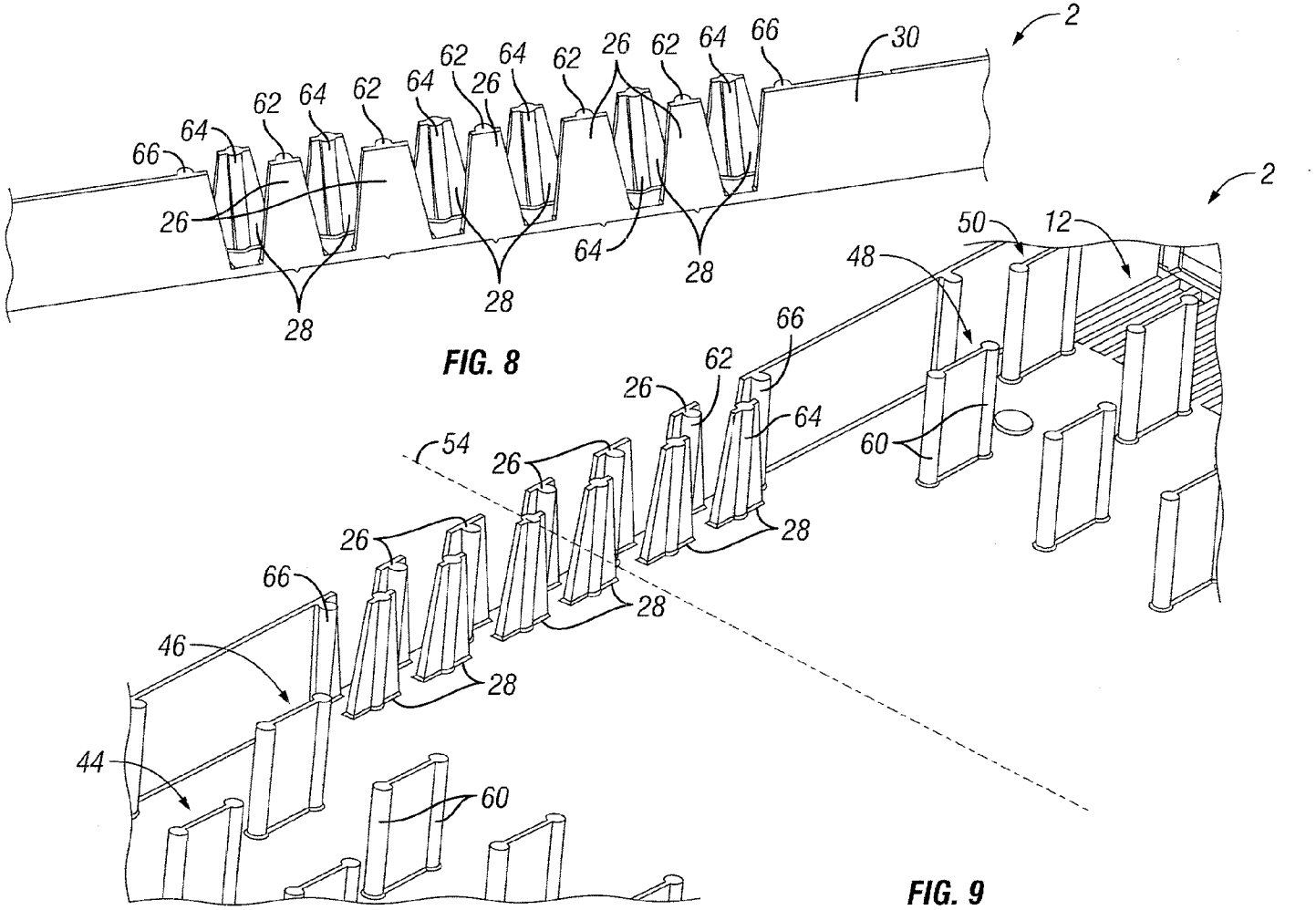
FIG. 8 is an underside perspective detail view of the outside of an end portion of the ridge vent of FIG. 1.
FIG. 9 is an underside perspective view (inside) of a portion the ridge vent of FIG. 1.

Outside and inside perspective detailed views of the ends of ridge vent 2 are shown in FIGS. 8 and 9, respectively. It is appreciated, and as previously discussed, ridge vent 2 is bendable along its longitudinal axis 54 to match the pitch of roof 4. End 30 of ridge vent 2 will, therefore, close by virtue of alternating tabs 26 and 28 (see, also, FIG. 1). By bending ridge vent 2 along its longitudinal axis 54, alternating tabs 26 and 28 will close off or fill in space therebetween to form a wall. It is further appreciated that these vent sections may butt up against each other when installed. In an illustrative embodiment, injector pins 62 are offset on tabs 26 towards the interior of ridge vent 2 to make sure the end of the vent is able to be abutted against an adjacent ridge vent. The inner row of alternating tabs 28 also have injector pins 64, each located at about the center of each tab. End pins 66 are located at the periphery of the rows of alternating tabs 26 and 28 to further assist sealing off the end of ridge vent 2 when bent along longitudinal axis 54 over roof 4. The view in FIG. 9 further shows the rows of ribs 44, 46, 48, and 50. The row of louvers 12 are shown in position adjacent the row of ribs 50.

Figure 10:
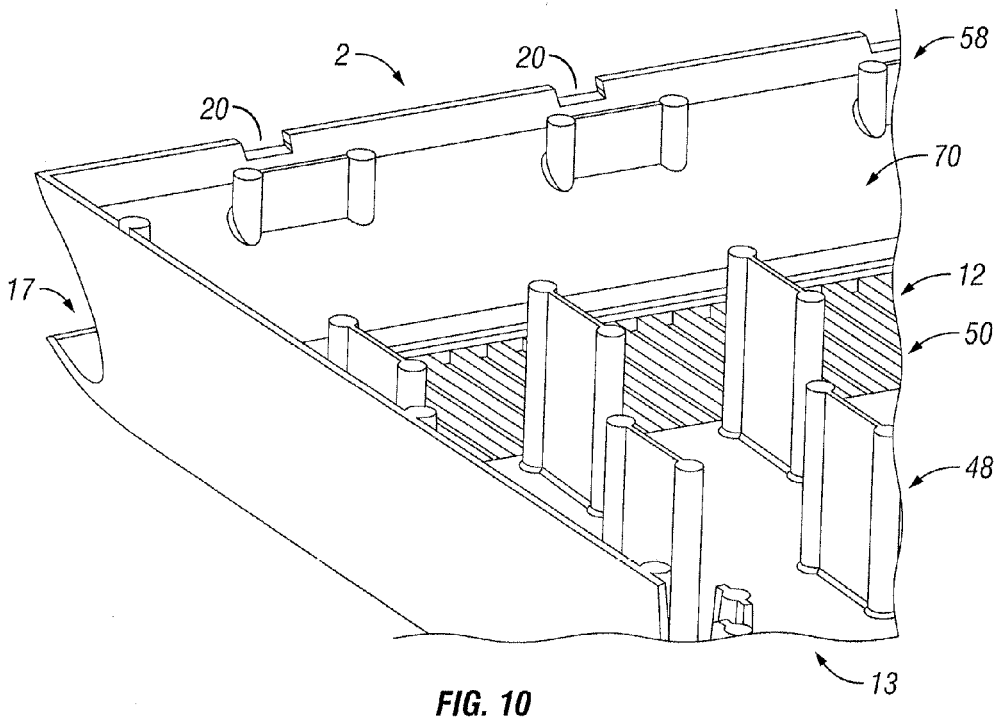
FIG. 10 is a perspective, underside detail view of a portion of the ridge vent of FIG. 1.

A detail underside perspective view of a corner portion of ridge vent 2 is shown in FIG. 10. This view depicts rib rows 48 and 50 located adjacent louver row 12. An interior wall 70 that forms delta wing edge 17 is shown with supporting inner wall tab 58. Again, each tab is located behind a weep hole 20. It may be appreciated from this view how rib rows 48 and 50 (as well as 44 and 46) and the row inner wall tabs 58 (as well as the row of inner wall tabs 56) assist providing support to ridge vent 2.

Figure 11:
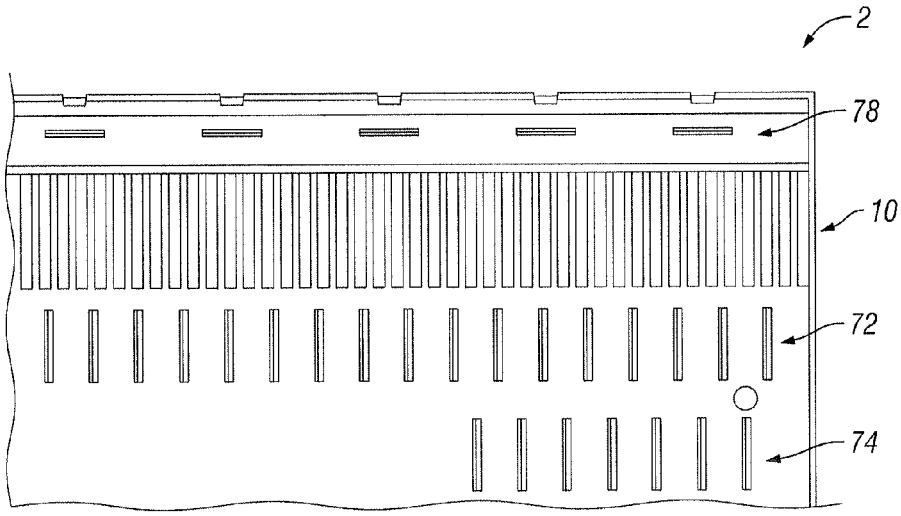
FIG. 11 is an underside view of a portion of a ridge vent.

An underside view of another illustrative embodiment of ridge vent 2 is shown in FIG. 11 where rows of ribs 72 and 74 may be located adjacent row of louvers 10. Rows 72 and 74, however, do not include injection pins like the prior embodiment. This is the same with the alternative embodiment of inner wall tabs 78 in contrast to injector pins on tabs 58 with injector pins formed thereon.

It is appreciated that the vent as designed may adjust from a 3/12 to about a 16/12 pitch. It is further appreciated that ridge vent 2 may have different widths. For example an illustrative 11-inch wide ridge vent version may accommodate standard cap shingles; a 9-inch wide ridge vent may be used with dimensional cap shingles; and an illustrative 13-inch wide ridge vent may accommodate metric cap shingles. It is appreciated that the shingles do not cover the vent openings. Again, the louvers are located on top panel 13 and the shingles do not cover them when installed. It is further appreciated that these ridge vents have a particular leading edge design that promotes better ventilation by drawing air out of both sides of the vent for all three sizes shown.

Figure 12:
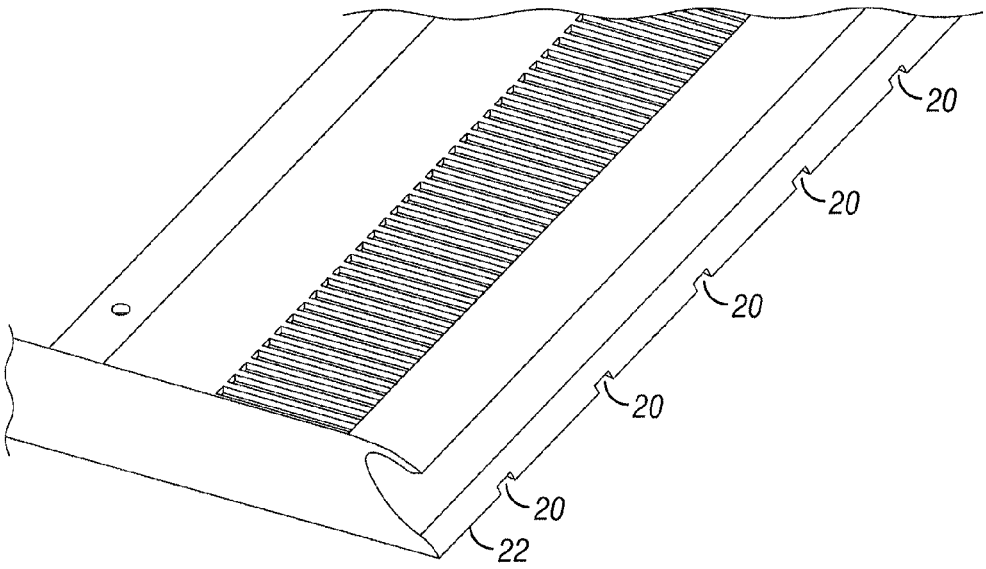
FIG. 12 is a perspective, detail view of a portion of the ridge vent of FIG. 1.
Figure 13:
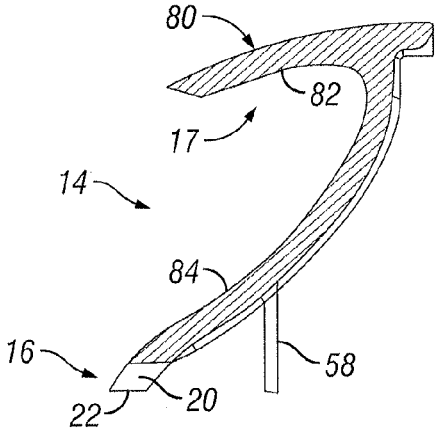
FIG. 13 is a cross-sectional, detail view of the edge profile portion of the ridge vent of FIG. 1.

Top perspective detail and cross-sectional detail views of portions of ridge vent 2 are shown in FIGS. 12 and 13. Weep holes 20, located on bottom edge 22 at the sides of ridge vent 2 assist draining any fluid that enters the ridge vent. Also shown are inner wall 70, and the row inner wall tabs 58, each of which is located behind one weep hole 20 as previously identified. Again, inner wall tabs 56 and 58 assist in stopping wind-driven rain from entering further into ridge vent 2. As shown in these drawings, the plurality of weep holes 20 are positioned at regular intervals along bottom edge 22 of the sides of ridge vent 2.

The cross-sectional view of leading edge 14 shown in FIG. 13 also depicts delta wing or compound curve profile 17 (the same will be the case for compound curve 15 as well). For both delta wing profiles 15 and 17, there is a curved edge 80 that extends slightly downwardly over channel 82 located between curved edge 80 and opposed sloped edge 84. With regard to sloped edge 84, it illustratively includes weep holes 20 and terminates at bottom edge 22. It is respectfully believed that this design assists preventing air that blows across ridge vent 2 from entering louvers 10 and 12 (see, also, FIG. 5).

It is still further appreciated that ridge vent 2, may include either a higher or lower profile embodiments. For example, ridge vent 2 may have about a 0.92-inch height or about a 0.69-inch height. Both heights provide similar leading edge configurations as previously discussed. A lower profile shown provides a unique appearance with an even darker shadow line and lower appearance perceived profile, making it less noticeable from the ground. It is appreciated that in the illustrative embodiment shown, the lower profile vent may have a decreased vent opening, totaling about 12.7 square inches per lineal foot. The lower profile may also be installed with a coil nail gun for faster installation.

Figure 14:
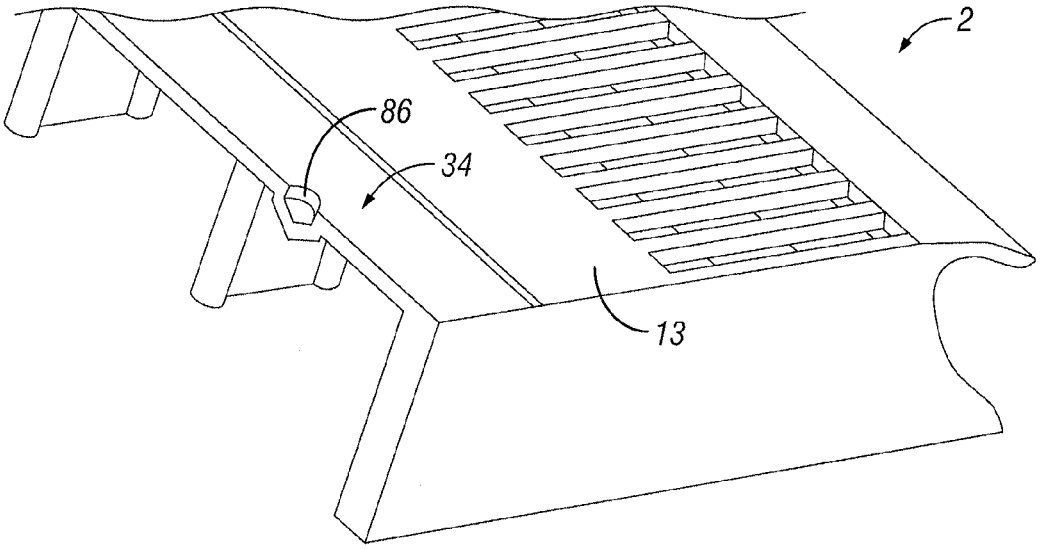
FIG. 14 is a perspective partial cut away detailed view of a portion of the ridge vent of FIG. 1.
Figure 15:
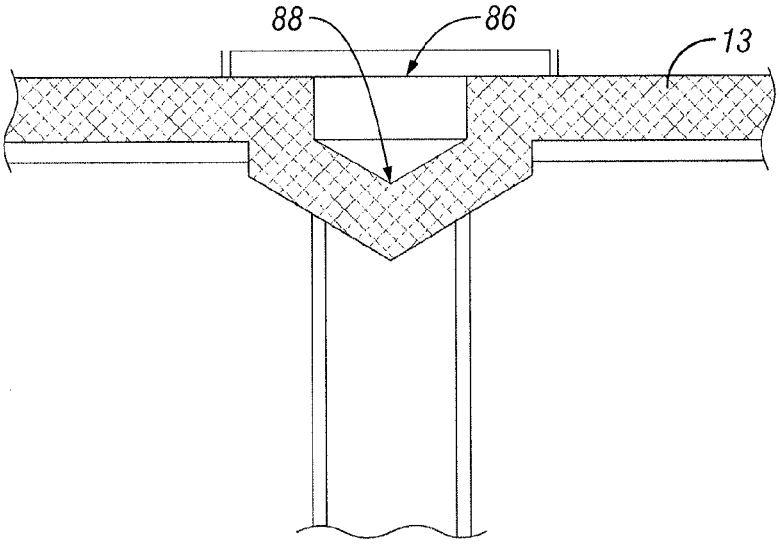
FIG. 15 is a detail, sectional view of a nail locator portion of the ridge vent.

Perspective partial cutaway and detailed sectional views of ridge vent 2 are shown in FIGS. 14 and 15. These views demonstrate nail locator 86 that may be formed on top panel 13 of ridge vent 2 along nail line 34 (as well as nail line 32). As shown, nail locators 86 are not holes, so when a nail is installed through the plastic material, it too seals around the nail. It is appreciated that indent portion 88 of nail locator 86 assists in the initial alignment for nailing into roof 4. Indent portion 88 has an angled base that may help hold the nail tip as it is driven through ridge vent 2. In an illustrative embodiment, there may be six nail locators 86 used on a 4 foot section of ridge vent 2. It is further appreciated that ridge vent 2 is configured so that additional nails will go through the nailing area when the cap shingles are installed over the center of the vent. It is also appreciated that nail lines 32 and 34 run down rows of ridge vent 2 as shown here and in FIG. 1. It is further appreciated that ridge vent 2 may be installed in full sections or may be cut into desired lengths. It is appreciated from this view, particularly FIG. 10 in contrast to FIG. 8, that the nailing area may run between rows of support ribs.

Figure 16:
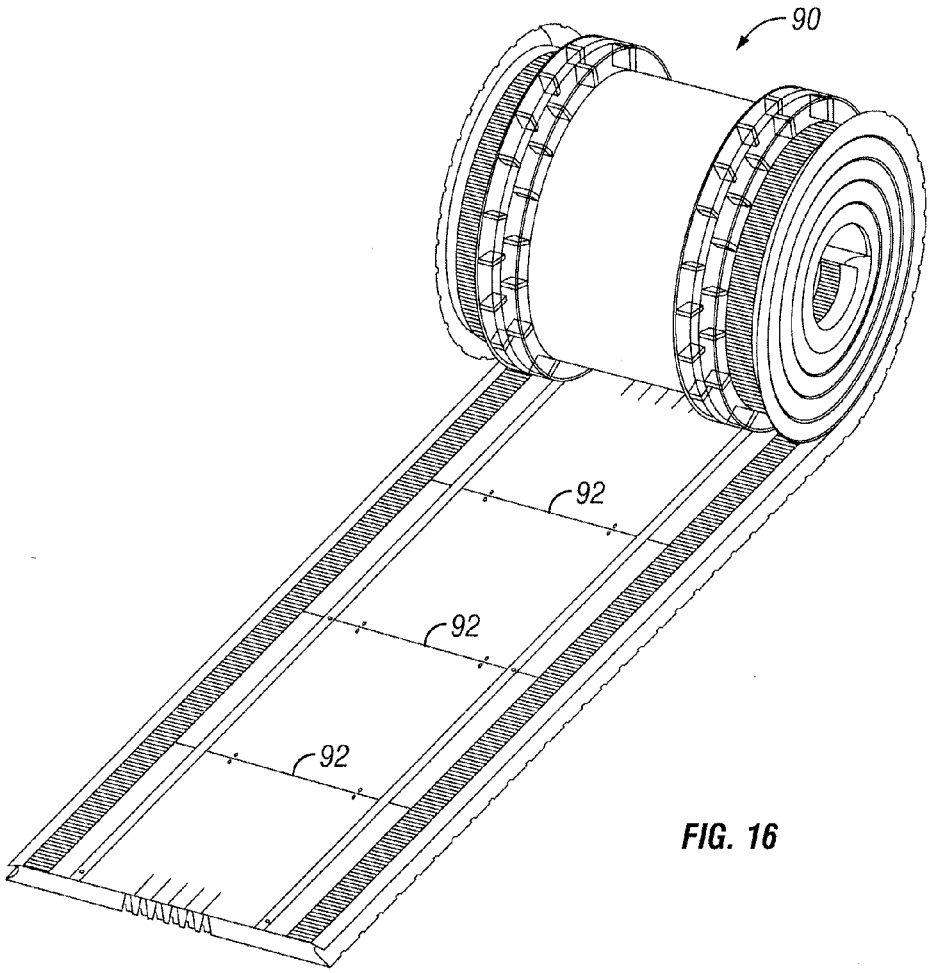
FIG. 16 is a perspective view of a rollable version of the ridge vent of FIG. 1.
Figure 17:
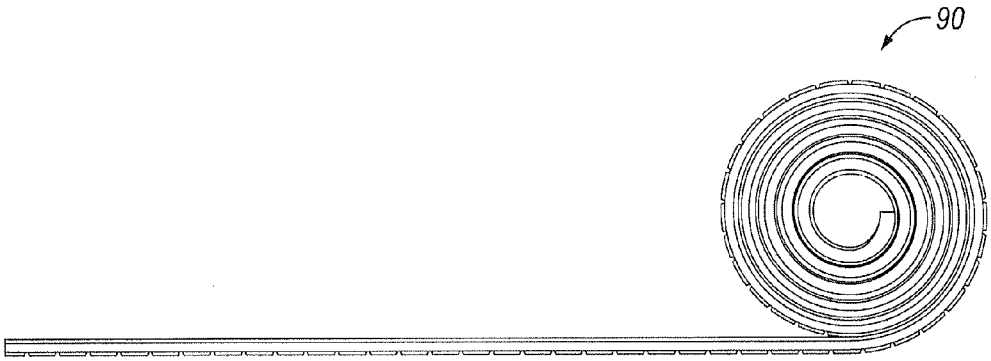
FIG. 17 is a side view of a rollable version of the ridge vent of FIG. 16.

Perspective and side views of a rollable version 90 of ridge vent 2 are shown in FIGS. 16 and 17. Rollable ridge vent 90 allows flexibility in both manufacturing variable lengths and installing a longer section of ridge vent. As shown in FIG. 16, ridge vent 90 is simply unrolled and then cut as needed. Cut line guides 92 may be located about every foot as a measuring and cutting guide. Illustratively, ridge vent 90, such as that shown, may be rolled in 10, 20, 30, and 50 foot lengths.

Figure 18:
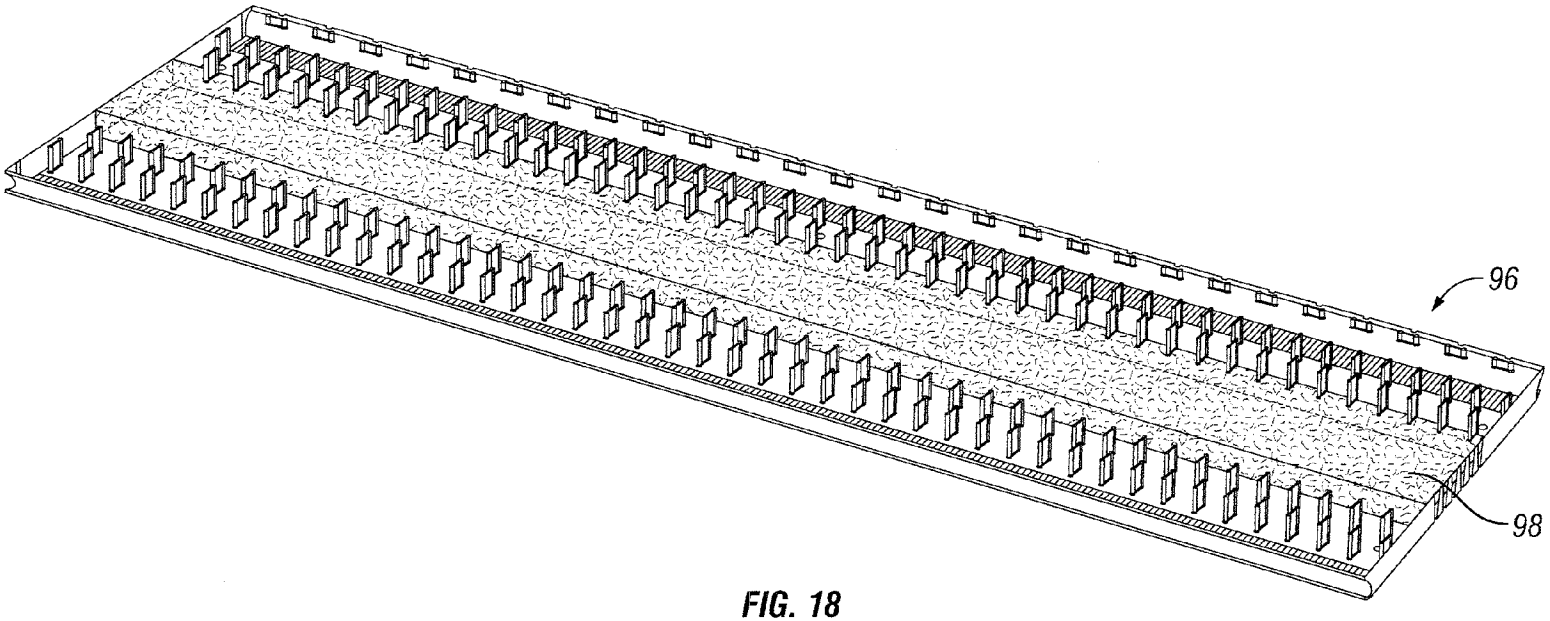
FIG. 18 is an underside perspective view of the ridge vent similar to that of FIG. 1, including a filter material.
Figure 19:
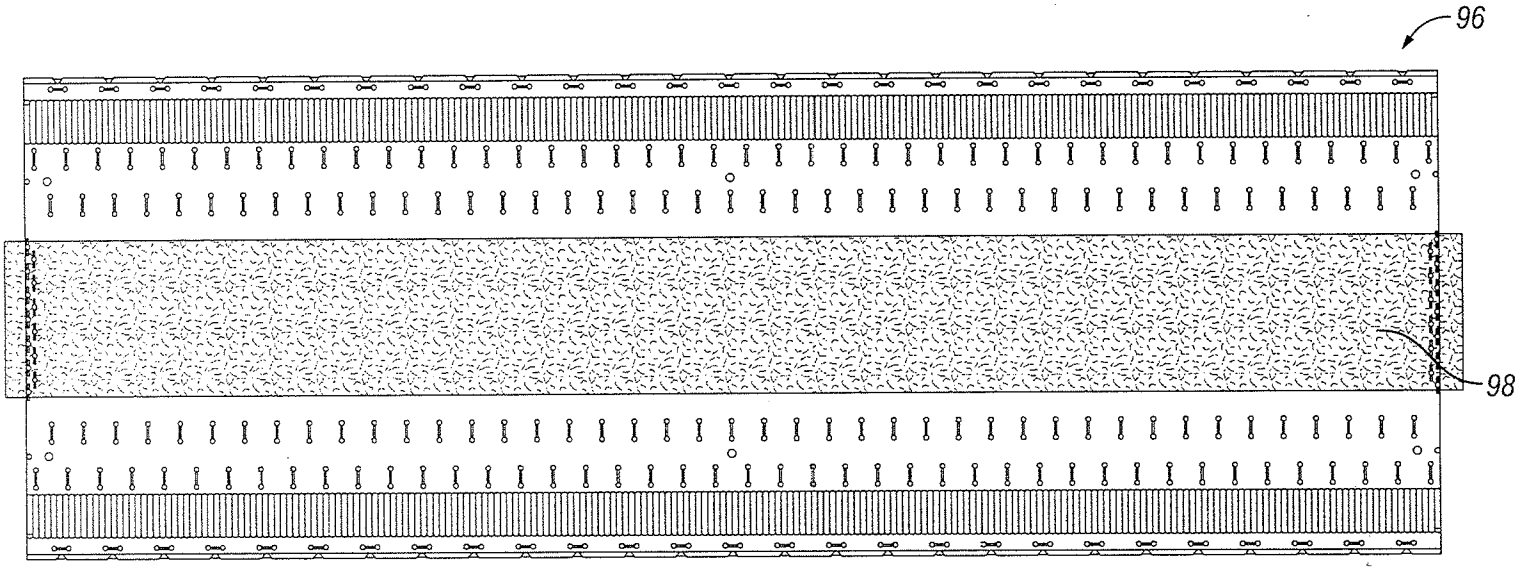
FIG. 19 is an underside view of the ridge vent similar to that of FIG. 18, including a filter material.
Figure 20:
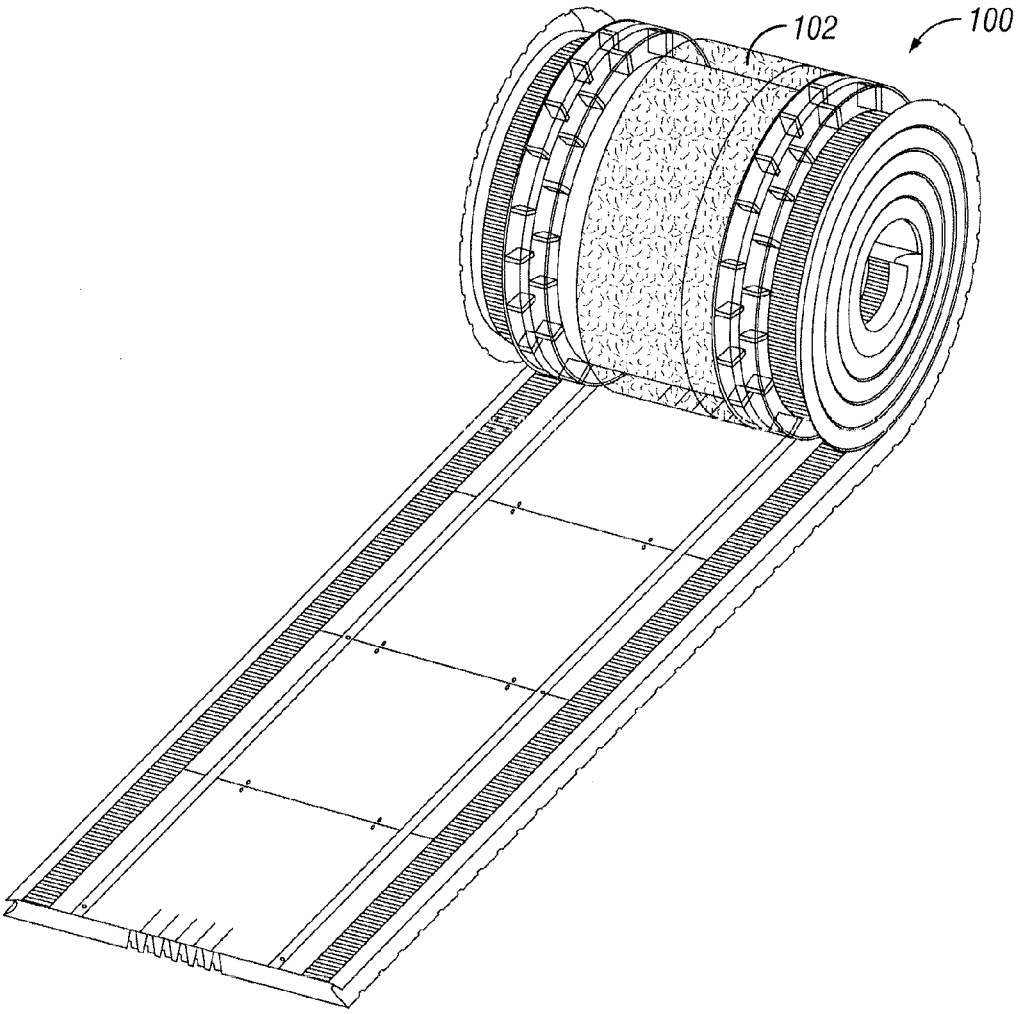
FIG. 20 is another perspective view of a rollable ridge vent including a filler material.

Underside perspective and underside views of ridge vent 96 having a filter material 98 applied thereon are shown in FIGS. 18 and 19. A perspective view of a rollable ridge vent 100 with a filter material also applied thereon is shown in FIG. 20. Filter materials 98 and 102, such as that shown in these figures, may be added as a layer of protection to stop snow and/or dust from entering the attic cavity. It is appreciated that such a filter should not affect the air flow and the net free ventilation area of the ridge vent. In an illustrated embodiment, the filter material may be a loose, interlocking material that has low material density to serve as a barrier, but does not substantially affect air flow. The filter may be located in the underside center of the vent and cover the slot that is cut in the peak of the roof. In an illustrative embodiment, the filter may avoid the nail supports. It is appreciated that the filter may be attached to the ridge vent by various means, including gluing, hot staking, or mechanically attaching it with fasteners such as rivets, staples, or screws. Another mechanism for attaching the filter is to have pins with points on the underside of the vent. The filter may then be pressed onto the pins and using a heat probe to secure the filter in place. The view shown in FIG. 20 includes filter material 102 in the rolled ridge vent 100 embodiment. It is appreciated that filter material 102 may act and be attached, just as that previously described, but here may be installed in a rolled ridge vent.

Figure 21:
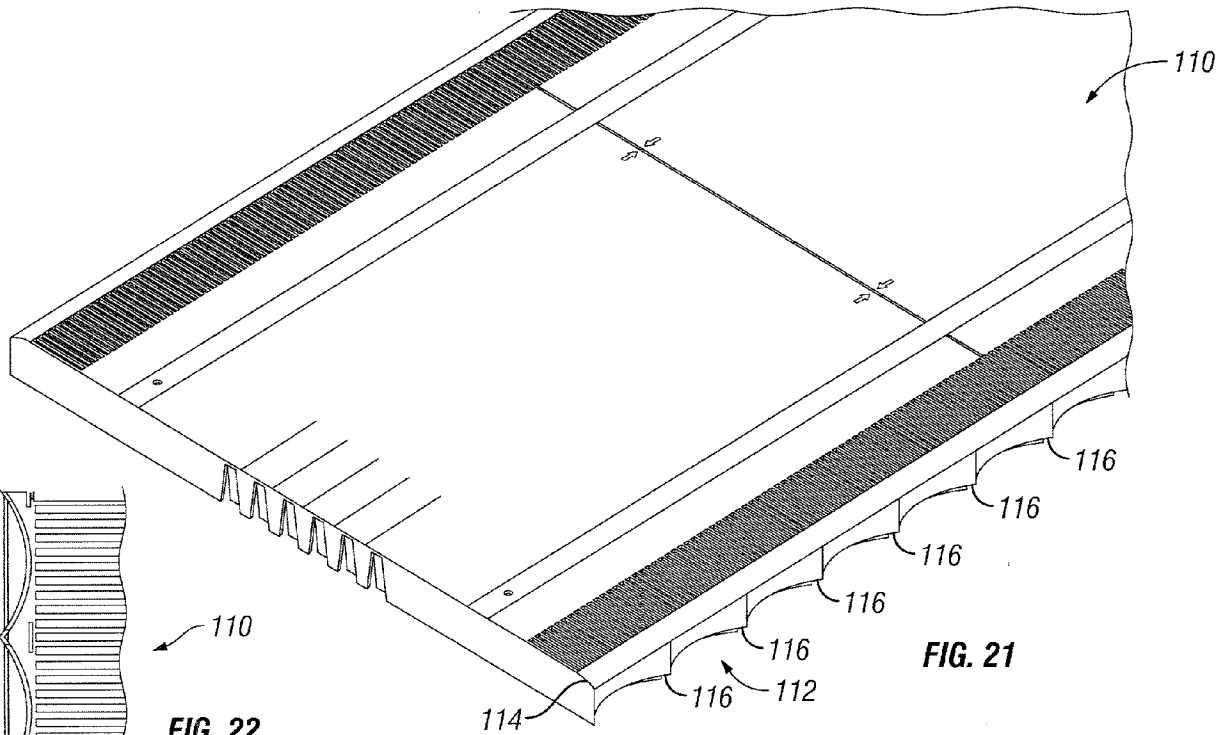
FIG. 21 is a perspective detail view of another illustrative embodiment of the present disclosure.
Figure 22:
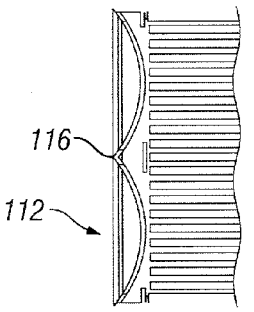
FIG. 22 is an underside detail view the illustrative embodiment of the present disclosure of FIG. 21.
Figure 23:
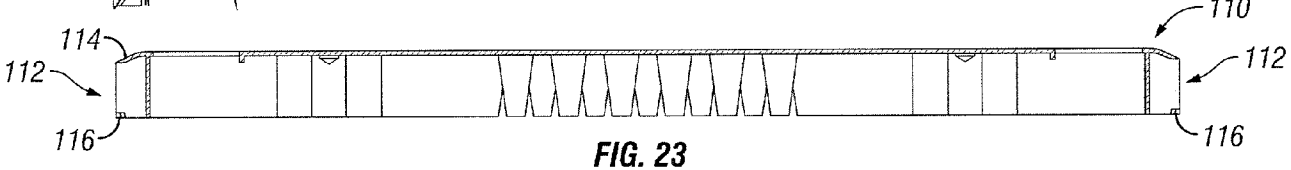
FIG. 23 is cutaway end view the illustrative embodiment of the present disclosure of FIG. 21.

Perspective detail, bottom detail, and cutaway views of another illustrative embodiment of a ridge vent 110 are shown in FIGS. 21, 22, and 23. This alternative wave edge design includes a repeating wave edge 112 extending along the edge profile of the sides of ridge vent 110. This wave design creates a sharp lip 114 with recessed areas designed to create pockets of low pressure in front of the vent to promote air flow out of same, while protecting it from wind-driven rain and snow. Weep holes 116 are located at or adjacent the furthest extending point on the waves to protect and better provide drainage. The side of the vent is capped with this repeated structure along the sides of the ridge vent to create greater surface areas to the outer profile of the vent.

Figure 24:
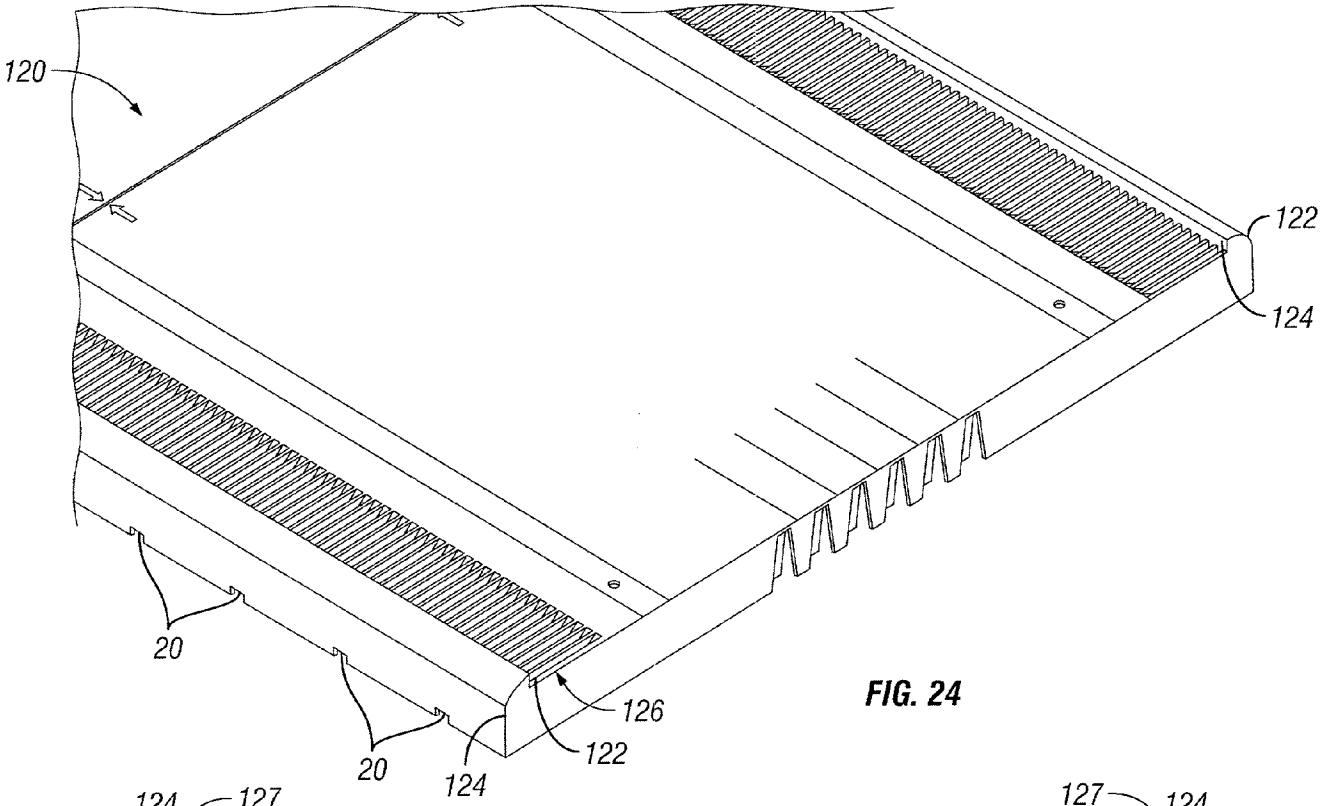
FIG. 24 is a perspective detail view of another illustrative embodiment of the present disclosure.
Figure 25:
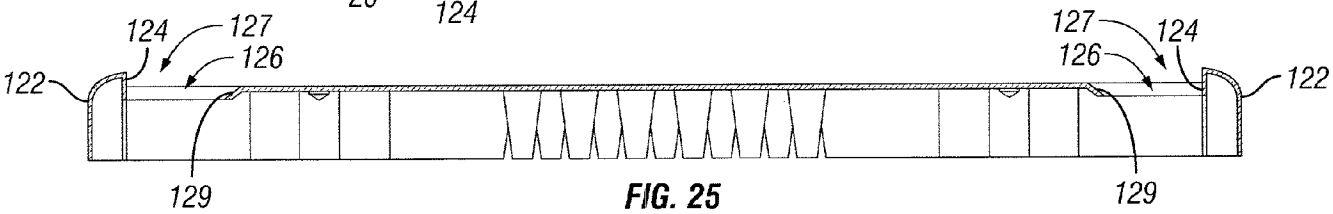
FIG. 25 is cutaway end view the illustrative embodiment of the present disclosure of FIG. 24.

Perspective detail and cross-sectional views of another illustrative embodiment of a ridge vent 120 are shown in FIGS. 24 and 25. These views show an alternate outer edge profile design having dual walls 122 and 124. In this illustrative embodiment, louvers 126 are seated lower than the outside leading edge. Shingles are still installed along the center of the vent, however. Illustratively, louvers 126 may be thicker in depth for greater support. Additionally louver 125 may be located in recessed channels 127. A taper 129 may be formed at louvers 126 to give improved protection to the interior of the vent.

Figures 26A, 26B, 26C, 26D:
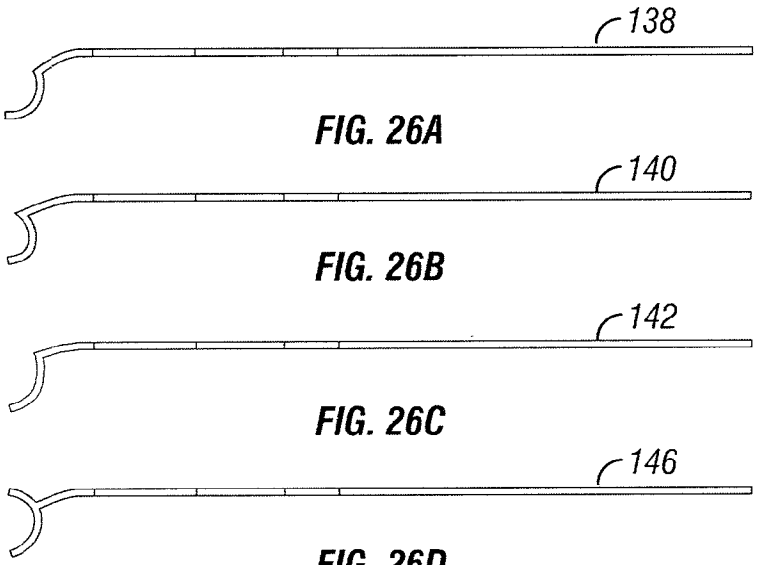
FIG. 26 A through H shows a plurality of illustrative edge profile designs for use as part of a ridge vent of the prior embodiments.
Figures 26E, 26F, 26G, 26H:
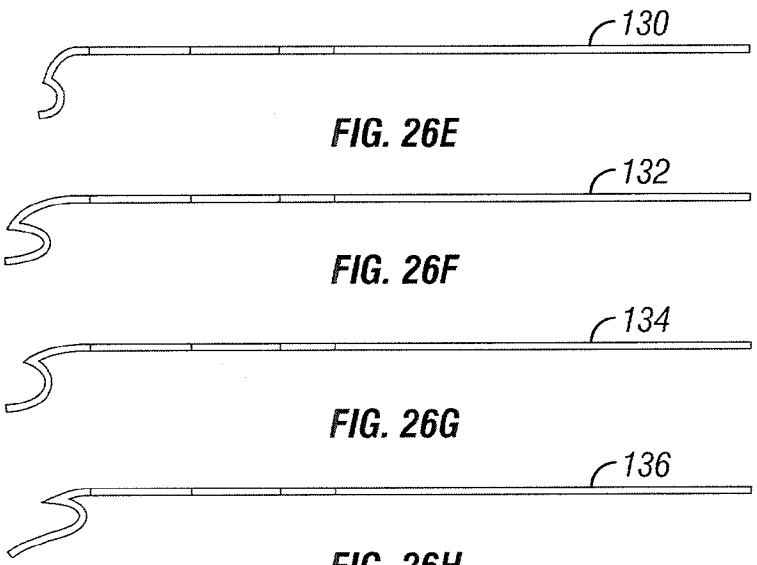

A plurality of illustrative edge profile designs for use as part of ridge vents 130 through 146 are shown in FIG. 26A through 16H. These illustrative, leading edge designs may be used to affect the air flow and weather protection for the ridge vent.

Figure 27:
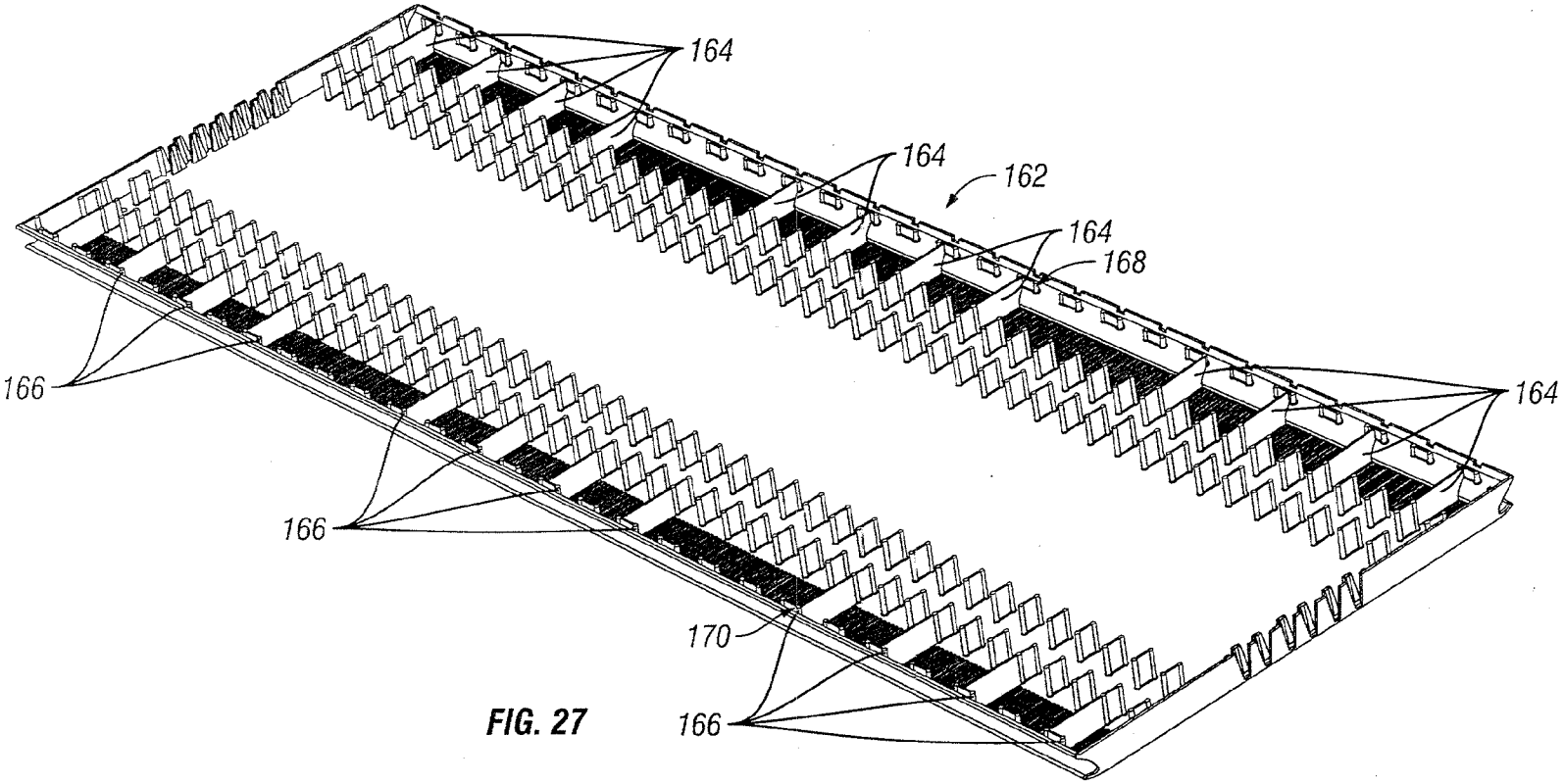
FIG. 27 is an underside perspective view of another illustrative embodiment of the present disclosure.

Another illustrative embodiment of the present disclosure provides a ridge vent 162 that includes additional support ribs periodically located along longitudal extent of the ridge vent 162. As shown in the underside view of ridge vent 162 of FIG. 27, much of it is structurally similar, if not the same as, that shown in the previous embodiments, including the louvers 10 and 12, leading edges 14 and 16 with the delta wing-8 cross sections 15 and 17 respectively, and rib rows 44, 46, 48, and 50. Ridge vent 162 differs, however, in that it includes plurality of support ribs 164 and 166 periodically spaced in row form as shown in FIG. 27. It is appreciated that these rib supports 164 and 166 extend from a rib to a tab (such as tabs 168 and 170, respectively). It is appreciated that plurality of tabs 168 and 170 are similar to the tabs 56 and 58 previously discussed with respect to ridge vent 2.

Figure 28:
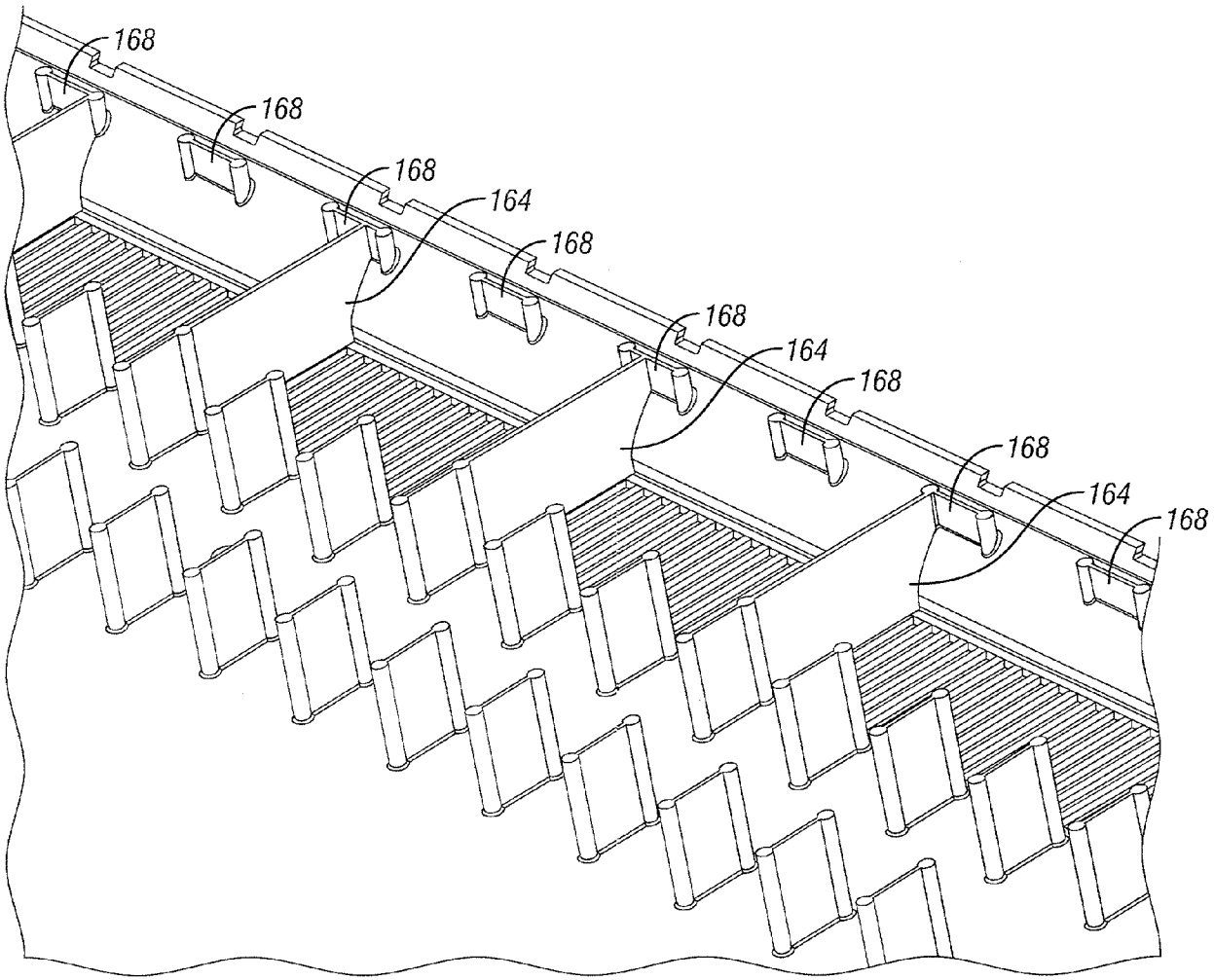
FIG. 28 is an underside detail perspective view of a portion of the additional illustrative embodiment of the present disclosure shown in FIG. 27.

The detail underside perspective view of ridge vent 162 further depicts ridge vents 164 tied into tabs 168 as illustratively shown in FIG. 28. It is appreciated that rib supports 166 tie into corresponding ribs 170 in the same manner. It is appreciated that support ribs 164 and 166 may be periodically placed along the longitudal extent of ridge vent 162 to provide additional structural support of same. Another illustrative embodiment, rib supports 164 and 166 may be placed in the vicinity of nail locaters such as nail locaters 86 from ridge vent 2. This configuration allows further structural support of the ridge vent during installation when nails are being inserted through the nail locaters.

Although the present disclosure has been described with reference to particular means, materials, and embodiments, from the foregoing description, one skilled in the art can easily ascertain the essential characteristics of the disclosure, and various changes and modifications may be made to adapt the various uses and characteristics without departing from the spirit and scope of the disclosure.

What is claimed is:

1. A ridge vent comprising:

a longitudinally-extending top panel bendable along a longitudinally-extending axis;

a longitudinally-extending first side depending from the top panel and located substantially parallel to, and spaced apart from, the longitudinally-extending axis;

a longitudinally-extending second side depending from the top panel and located substantially parallel to, and spaced apart from, the longitudinally-extending axis;

wherein the longitudinally-extending first side is located on an opposite side of the longitudinally-extending axis from the longitudinally-extending second side;

a first end depending from the top panel and extending between the longitudinally-extending first and second sides;

wherein the top panel, the first end, and the longitudinally-extending first and second sides collectively form a ridge vent interior segregated from exterior of the ridge vent;

a first plurality of openings formed on the top panel that are positioned adjacent each other;

wherein first the plurality of openings collectively longitudinally-extend along a first longitudinal extent that is substantially parallel to, and spaced apart from, the longitudinally-extending axis;

a second plurality of openings formed on the top panel that are positioned adjacent each other;

wherein the second plurality of openings collectively longitudinally extend along a second longitudinal extent that is substantially parallel to, and spaced apart from, the longitudinally-extending axis;

wherein the first plurality of openings is located on an opposite side of the longitudinally-extending axis from the second plurality of openings;

wherein the top panel includes a first terminus that extends longitudinally along the first side, wherein the first terminus is curved downwardly with respect to the top panel to a first longitudinally extending edge;

wherein the longitudinally-extending first side is composed of a longitudinally-extending first arcuate side panel having a concave shape directed toward the ridge vent interior, wherein a first portion of the concave shape of the longitudinally-extending first arcuate side panel is located underneath the top panel, and a second portion of the longitudinally-extending concave shape of the longitudinally-extending first arcuate side panel is located away from underneath the top panel;

wherein the longitudinally-extending second side is composed of a longitudinally-extending second arcuate side panel having a concave shape directed toward the ridge vent interior, wherein a first portion of the concave shape of the longitudinally-extending second arcuate side panel is located underneath the top panel, and a second portion of the longitudinally-extending concave shape of the longitudinally-extending second arcuate side panel is located away from underneath the top panel;

wherein the first end depending from the top panel and extending between the longitudinally-extending second first and second sides includes a first plurality of depending tabs, wherein each of the first plurality of depending tabs are spaced apart from each other; and a second plurality of depending tabs, wherein each of the second plurality of depending tabs are spaced apart from each other, wherein the second plurality of depending tabs are positioned substantially parallel to first plurality of depending tabs;

wherein each of the second plurality of depending tabs faces a space located between each of the first plurality of depending tabs.

2. The ridge vent of claim 1, further comprising a second end depending from the top panel and extending between the the longitudinally-extending first and second sides and spaced apart from the first end.

3. The ridge vent of claim 2, wherein the second end depending from the top panel and extending between the the longitudinally-extending first and second sides includes a first plurality of depending tabs, wherein each of the first plurality of depending tabs are spaced apart from each other, and a second plurality of depending tabs, wherein each of the second plurality of depending tabs are spaced apart from each other, wherein the second plurality of depending tabs are positioned substantially parallel to first plurality of depending tabs, and wherein each of the second plurality of depending tabs faces a space located between each of the first plurality of depending tabs.

4. The ridge vent of claim 1, wherein the longitudinally-extending first side includes a plurality of weep holes located on the second portion of the longitudinally-extending concave shape of the longitudinally-extending first arcuate side panel.

5. The ridge vent of claim 4, further comprising a plurality of tabs, wherein one tab of the plurality of tabs is located on an underside portion of the longitudinally-extending first arcuate side panel of the longitudinally-extending first side adjacent one weep hole of the plurality of weep holes.

6. The ridge vent of claim 1, wherein the longitudinally-extending second side includes a plurality of weep holes located on the second portion of the longitudinally-extending concave shape of the longitudinally-extending second arcuate side panel.

7. The ridge vent of claim 6, further comprising a plurality of tabs, wherein one tab of the plurality of tabs is located on an underside portion of the longitudinally-extending second arcuate side panel of the longitudinally-extending second side adjacent one weep hole of the plurality of weep holes.

8. The ridge vent of claim 1, wherein the top panel includes an underside surface facing the ridge vent interior, wherein the ridge vent further comprises a plurality of first row of downward-depending tabs and a second row of downward-depending tabs, wherein the first row of downward-depending tabs collectively longitudinally-extend along a first longitudinal extent that is substantially parallel to, and spaced apart from, the longitudinally-extending axis.

9. The ridge vent of claim 8, wherein the second row of downward-depending tabs collectively longitudinally-extend along a second longitudinal extent that is substantially parallel to, and spaced apart from, the first row of downward-depending tabs and the longitudinally-extending axis.

10. The ridge vent of claim 8, wherein each tab from the first row of the plurality of tabs is located transverse to the longitudinally-extending axis of the top panel, and the second row of the plurality of tabs is located transverse to the longitudinally-extending axis of the top panel.

11. The ridge vent of claim 10, wherein each tab of the first row of the plurality of tabs is located parallel to and non-collinear to each tab of the second row of the plurality of tabs.

12. The ridge vent of claim 10, wherein each tab from the first row of tabs includes a pin formed thereon.

13. The ridge vent of claim 12, wherein each tab from the second row of tabs includes a pin formed thereon.

14. A ridge vent comprising:

a longitudinally-extending top panel bendable along a longitudinally-extending axis;

a longitudinally-extending first side depending from the top panel and located substantially parallel to, and spaced apart from, the longitudinally-extending axis;

a longitudinally-extending second side depending from the top panel and located substantially parallel to, and spaced apart from, the longitudinally-extending axis;

wherein the longitudinally-extending first side is located on an opposite side of the longitudinally-extending axis from the longitudinally-extending second side;

a first end depending from the top panel and extending between the longitudinally-extending first and second sides;

wherein the top panel, the first end, and the longitudinally-extending first and second sides collectively form a ridge vent interior segregated from exterior of the ridge vent; and wherein the top panel includes a first terminus that extends longitudinally along the longitudinally-extending first side, wherein the first terminus is curved downwardly with respect to the top panel to a first longitudinally extending edge;

wherein the longitudinally-extending first side is composed of a longitudinally-extending first arcuate side panel having a concave shape directed toward the ridge vent interior, wherein a first portion of the concave shape of the longitudinally-extending first arcuate side panel is located underneath the top panel, and a second portion of the longitudinally-extending concave shape of the longitudinally-extending first arcuate side panel is located away from underneath the top panel;

wherein the longitudinally-extending second side is composed of a longitudinally-extending second arcuate side panel having a concave shape directed toward the ridge vent interior, wherein a first portion of the concave shape of the longitudinally-extending second arcuate side panel is located underneath the top panel, and a second portion of the longitudinally-extending concave shape of the longitudinally-extending second arcuate side panel is located away from underneath the top panel; and wherein the longitudinally-extending top panel is rollable along its longitudinal-extending axis.

15. The ridge vent of claim 14, further comprising a first plurality of openings formed on the top panel that are positioned adjacent each other, wherein first the plurality of openings collectively longitudinally-extend along a first longitudinal extent that is substantially parallel to, and spaced apart from, the longitudinally-extending axis.

16. The ridge vent of claim 15, further comprising a second plurality of openings formed on the top panel that are positioned adjacent each other, wherein the second plurality of openings collectively longitudinally extend along a second longitudinal extent that is substantially parallel to, and spaced apart from, the longitudinally-extending axis.

17. The ridge vent of claim 16, wherein the first plurality of openings is located on an opposite side of the longitudinally-extending axis from the second plurality of openings, wherein the first end depending from the top panel and extending between the longitudinally-extending first and second sides includes a first plurality of depending tabs, wherein each of the first plurality of depending tabs are spaced apart from each other.

18. The ridge vent of claim 17, further comprising a second plurality of depending tabs, wherein each of the second plurality of depending tabs are spaced apart from each other, wherein the second plurality of depending tabs are positioned substantially parallel to first plurality of depending tabs, wherein each of the second plurality of depending tabs faces a space located between each of the first plurality of depending tabs.

19. A ridge vent comprising:

a longitudinally-extending top panel bendable along a longitudinally-extending axis;

a longitudinally-extending first side depending from the top panel and located substantially parallel to, and spaced apart from, the longitudinally-extending axis;

a longitudinally-extending second side depending from the top panel and located substantially parallel to, and spaced apart from, the longitudinally-extending axis;

wherein the longitudinally-extending first side is located on an opposite side of the longitudinally-extending axis from the longitudinally-extending second side;

wherein the top panel, first end, and first and second sides collectively form a ridge vent interior segregated from exterior of the ridge vent; and a first end depending from the top panel and extending between the first and second sides;

wherein the top panel includes a first terminus that extends longitudinally along the first side, wherein the first terminus is curved downwardly with respect to the top panel to a first longitudinally extending edge;

wherein the longitudinally-extending first side is composed of a longitudinally-extending first arcuate side panel having a concave shape directed toward the ridge vent interior, wherein a first portion of the concave shape of the longitudinally-extending first arcuate side panel is located underneath the top panel, and a second portion of the longitudinally-extending concave shape of the longitudinally-extending first arcuate side panel is located away from underneath the top panel;

wherein the longitudinally-extending second side is composed of a longitudinally-extending second arcuate side panel having a concave shape directed toward the ridge vent interior, wherein a first portion of the concave shape of the longitudinally-extending second arcuate side panel is located underneath the top panel, and a second portion of the longitudinally-extending concave shape of the longitudinally-extending second arcuate side panel is located away from underneath the top panel;

a first plurality of depending tabs, wherein each of the first plurality of depending tabs are spaced apart from each other; and a second plurality of depending tabs, wherein each of the second plurality of depending tabs are spaced apart from each other, wherein the second plurality of depending tabs are positioned substantially parallel to first plurality of depending tabs, wherein each of the second plurality of depending tabs faces a space located between each of the first plurality of depending tabs.

* * * * *